US005599136A

United States Patent [19]

Wilke

[11] Patent Number: 5,599,136

[45] Date of Patent: Feb. 4, 1997

[54] STRUCTURE FOR TOPOGRAPHY STABILIZATION AND RUNOFF CONTROL

[76] Inventor: Douglas A. Wilke, 38 Roosevelt Ave., Glen Head, N.Y. 11545-1531

[21] Appl. No.: 44,527

[22] Filed: Apr. 7, 1993

[51] Int. Cl.[6] ..... E02B 3/04

[52] U.S. Cl. ..... 405/15; 405/21; 405/258

[58] Field of Search ..... 405/284–287, 405/258, 15–21, 31–35; 52/233; 47/83

[56] References Cited

U.S. PATENT DOCUMENTS

| | | | |
|---|---|---|---|
| 1,402,438 | 1/1922 | Nichols | 52/233 X |
| 3,006,038 | 10/1961 | Sullivan | 405/284 X |
| 3,189,950 | 6/1965 | Johnson | 52/233 |
| 3,552,079 | 1/1971 | Mortensen | 52/233 X |
| 4,503,647 | 3/1985 | Post | 52/233 |
| 4,787,185 | 11/1988 | Gascho | 52/233 |
| 4,897,955 | 2/1990 | Winsor | 52/233 X |
| 4,905,409 | 3/1990 | Cole | 52/233 X |
| 5,108,232 | 4/1992 | Strassil | 405/286 |
| 5,174,078 | 12/1992 | West | 52/233 |

FOREIGN PATENT DOCUMENTS

| | | | |
|---|---|---|---|
| 2184472 | 6/1987 | United Kingdom | 405/284 |

*Primary Examiner*—Dennis L. Taylor

[57] ABSTRACT

A three dimensional topography stabilization structure system of preformed, notched and pinned plastic plank to provide a means to form preplanned contours of earth medium cells adjacent to and at the land and water interface; and on land. The system creates contoured slopes above and below water at zero degree to forty five degrees. Within the cells are grown terrestrial vegetation, emergent aquatic vegetation and associated micro flora. The necessary environment of inclined planes, elevations and orientation is created to provide the nourishment balance of solar insolation, water cover, atmosphere and nutrient compulsory to sustain the flora and fauna specifically planned for the area. In addition said plank may be grooved and provided with splines to retain impervious sheet membrane at contours to form and retain selected earth medium filled channels for controlled fluid flow and basins for fluid retention. The system forms a topography wherein vegetation may be planted for stabilization against erosion and for remediation of toxic runoff and from designated channeled fluids.

12 Claims, 25 Drawing Sheets

TOPOGRAPHY STRUCTURE PERSPECTIVE VIEW

TOPOGRAPHY STRUCTURE PERSPECTIVE VIEW

TOPOGRAPHY STRUCTURE EXPLODED VIEW

BASIC – MODULAR PLANK – SYSTEM IMPLEMENTATION DETAILS

PERSPECTIVE VIEW

PERSPECTIVE VIEW

EXPLODED VIEW

EXPLODED VIEW

PERSPECTIVE VIEW

PERSPECTIVE VIEW

PLAN VIEW

PLAN VIEW

PLAN VIEW

SECTION

EXPLODED VIEW

PERSPECTIVE VIEW

SIDE VIEW

ISOMETRIC VIEW

EXPLODED VIEW

PERSPECTIVE VIEW

PERSPECTIVE VIEW

PLANK DRAINAGE SPACERS 79

ISOMETRIC

LINEAR RECTANGULAR POD 62

STRUCTURE FOR TOPOGRAPHY STABILIZATION AND RUNOFF CONTROL

BACKGROUND-FIELD OF INVENTION

The present invention relates to a modular structure designed to stabilize and/or establish sloped topography, shoreline and wetland topography, and to control, remediate and provide monitoring for land surface water runoffs, which maybe caused to flow via arranged channelled paths through natural and artificial materials within the structure.

BACKGROUND DESCRIPTION OF PRIOR ART

The prior art contains a number of structures primarily intended to stabilize relatively steep to near vertical banks and gradients. Prior art structures are frequently constructed of reinforced concrete or steel, sheet piling and similar planar wall structures and generally do not incorporate planting in their structural designs, and their large component sizes and weights and the heavy equipment construction methods required to build them, can preclude by regulation or inhibit their use in regulated environmentally sensitive areas. Prior art structures do not inherently allow for continued unbroken growth of flora and/or other environmental life upon the site of work. Where planting is provided in these structures (as in Strassil, U.S. Pat. No. 5,108,232), it is essentially for aesthetic purposes. None appear to incorporate methods for runoff channelling and control or water quality remediation in their designs.

Prior art structures do not inherently allow for perimeter defined slopes specifically required for vegetation and are not protected on all sides at the surface from erosion. These structures are stepped crib log wall of identical preformed units, diamond shaped steps, divided into triangles and preferably made of concrete (as in Guy Evans, UK, Patent GB 2184472A). In contrast the present invention is a system of plastic planks with surface perimeter enclosure planks on all sides parallel to the predetermined topography slope, orientation and grade mandatory for the growth of vegetation and associated micro flora. Angled planks can pass from above to below water as a barrier to resist perpendicular water flow at the slope upon which emergent vegetation will grow and micro flora will fasten. In addition the present invention provides a means to fasten sheet membrane for channeling and retention plus a means to fasten vegetation retention mesh.

Prior art structures of landscaping timber and wooden landscaping structures are horizontal and are not intended to form or stabilize topography other than a flat horizontal surface surrounded by a wood border, (as in Windsor, U.S. Pat. No. 4,897,955 and Cole, U.S. Pat. No. 4,905,409). In contrast the present invention provides a mechanism to build and maintain a topography of slopes of zero degree to forty five degrees and to allow for specific and varied orientations and grades, including varied grades within one structure by progressive adjustment of plank crossings.

Prior art structures of multi sides fastened with pins employ plank horizontally to form a retaining cell for commodity storage such as grain, which does not require or allow for biological/horticultural interaction between that which is stored and that which is structure, said prior art is of horizontal elements stacked vertically and is meant to be free standing with ventilation between planks, (Sullivan, Jr., U.S. Pat. No. 3,006,038) In contrast the present invention contains and is surrounded by earth medium and contains vegetation on topography slopes, oriented and at a grade required for plantlife growth. A mechanism is included to fasten and maintain in place sheet membrane and plant retaining mesh.

Prior art structures with notched connections are of wood and are to build vertical walls. They are not meant to build topography of earth slopes and have no provision for drainage and integration with vegetation to form a stabilized topography. (Johnson, U.S. Pat. No. 3,189,950; Mortensen U.S. Pat. No. 3,552,079; Post, U.S. Pat. 4,503,647; Gascho, U.S. Pat. 4,787,185). In contrast the present invention provides for a variable topography with voids between the structure for drainage, channeling and intergration of root structure of vegetation.

Prior art of notched timbers and plank are for application as structures requiring the walls to be vertical and perpendicular at corners, (Nicholas, U.S. Pat. No. 1,402,438; West, U.S. Pat. No. 5,174,078). In contrast the present invention is a topography structure of angles of zero degree to forty five degree with variable slopes and voids between members for the integration of adjacent and contained earth medium, vegetation and micro flora.

In contrast to this prior art, the present invention is designed to provide soil stabilization of sloped topography, of wetland and shoreline areas of normally flatter terrain. The present design incorporates features which provide for controlled flow, phyto (plantlife) water quality remediation, and monitoring of surface runoff passing across and through it, and incorporates both artificial and natural materials, including soils and plantings, for these purposes. These features, as well as the modular components light weight and ease of installation, and allowance for staged construction to provide for continued unbroken growth of environmental elements on the site make the present invention more acceptable than others, for use in environmentally sensitive areas. The structure (including use of environmentally benign, nonbiodegradable plastic components, and integrated membrane liners), and purpose (including flow channelling, water quality remediation and monitoring, of the current invention), is significantly different from known prior art.

SUMMARY

The invention provides a three dimensional topography structure system comprised of preformed interconnecting notched and pinned plastic planks. The plank form contoured cells to retain and stabilize earth medium above and below water at earth surface angles of zero degree to forty five degrees. Specifically planned earth medium, topographic angles, orientation and elevations are thus created to provide the necessary environment required for the nourishment balance of solar insolation, water cover, atmosphere and nutrient to sustain the flora and fauna specifically planned to be grown in the cells. At the land and water interface the system provides three dimensional topography to establish a predetermined biological benchmark required to define areas of emergent aquatic vegetation, adjacent terrestrial vegetation and associated micro flora.

The planks are grooved, splined and wedged to receive and hold plant retaining mesh and fluid retaining sheet liners for retention ponds and channels.

The plank is grooved and splined to interconnect vertically, plank to plank or through the use of double grooved spacers to provide drainage.

The topography structure is positioned by setting base, bottom plank wells onto prepositioned ground pin anchors.

The system includes the environment for, and the planting of vegetation to resist erosion.

The system includes the environment for, and the planting of vegetation for the remediation of toxic runoff and channeled fluids.

BRIEF DESCRIPTION OF THE DRAWINGS

In the accompanying drawings, like reference characters designate the same or similar parts throughout the figures.

DESCRIPTION OF THE PREFERRED EMBODIMENT OF THE INVENTION

Figure 1:
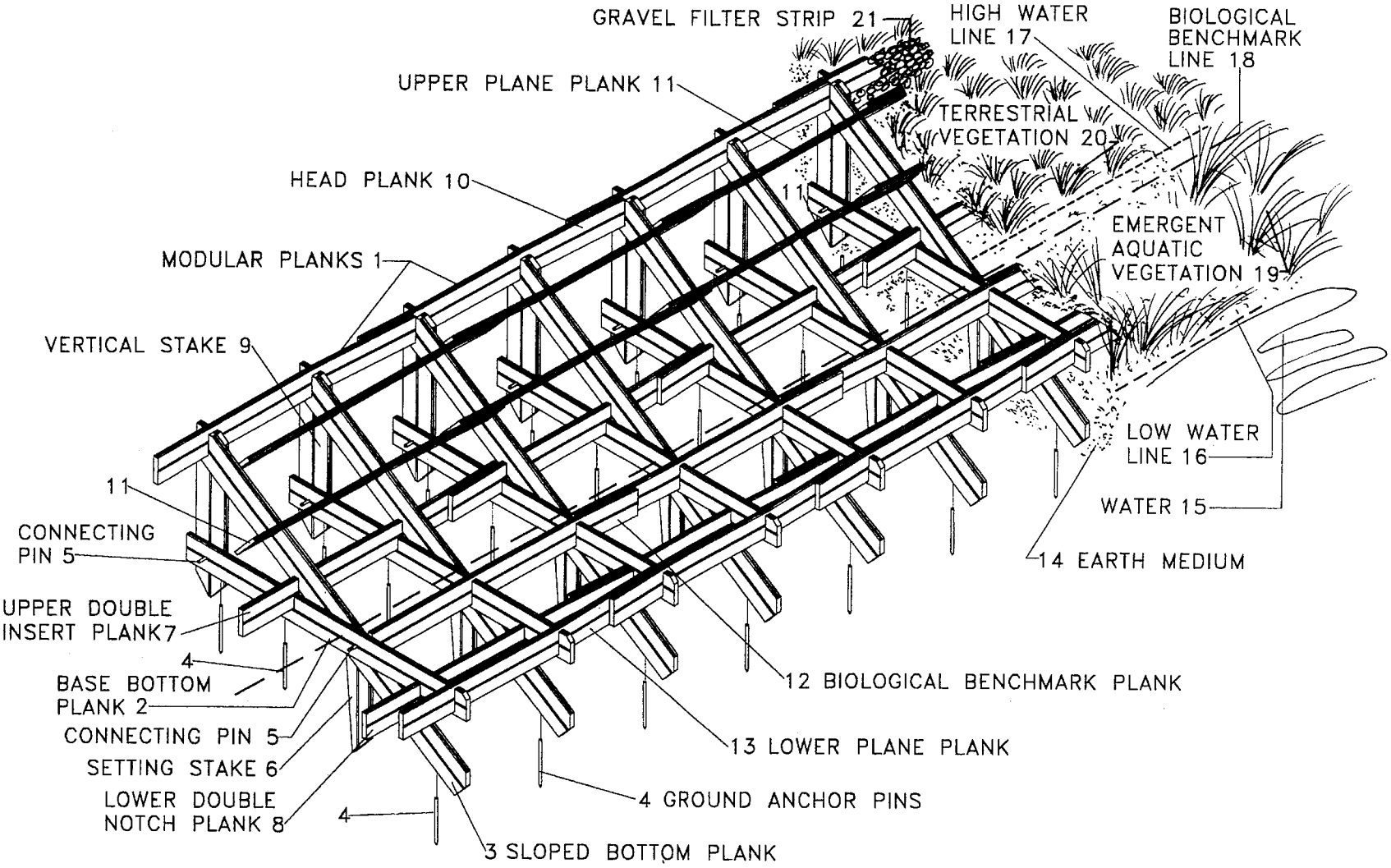
FIG. 1 is a perspective pictorial view of a representative topography structure and related earth, water plantlife and biological benchmark at the land and water interface.

The system forms a three dimensional topography structure from prefabricated ready-to-assemble frames and components providing a means for stabilization of natural and man-made topography and for preventing erosion without negative impact upon the existing environment, and providing a means for protecting, stabilizing, and continuing in kind and contour, wetlands sites, near vertical marshland hammocks and waterway shores subject to erosion and/or runoff water pollution; and for construction of water flow; control, direction, velocity, means, monitor and filters; and contour mass planting; said frames when employed as a system over areas of topography, being capable of staged installation such that within the areas of placement, the existing environment's flora growth may be continued.

Although a detailed embodiment of this invention is illustrated in the drawings and is described in detail in the written word, this invention contemplates and claims any plank structure topography system which will accomplish the herein described results of preventing erosion and providing a means for; stabilization of topography of soil medium, growth of vegetation and providing a means for channelling of water, and upgrading runoff water quality.

FIG. 1 shows a representative precut modular three dimensional topography linear structure. Linear planks interlock with sloped planks to form a linear topography frame of two slopes; the change of slope occurring at the biological bench line plank 12. Stock modular plastic plank is shown. Linear grooves are for hand grip in the field and for wedge fastening of mesh and membrane. Base bottom plank 2 is set at the required elevation and slope by inserting wells in the base of the plank into a predetermined layout of the ground anchor pins 4. Sloped bottom plank 3 is set into ground pin anchor 4 and pinned to base bottom plank 2 with connecting pin 5. Upper double insert plank 7 is positioned in notches in plank 2 and plank 3. Lower double notch plank 8 is positioned in notches in plank 2 and plank 3. Setting stake 6 and vertical stake 9 are set into the ground and pinned to bottom plank 2. Setting stake 6 is also pinned to slope plank 3. Head plank 10 is engaged in notches in vertical stake 9 and sloped bottom plank 3. Upper plank 11 is inserted in notches on the top of sloped bottom plank 3. Biological benchmark plank 12 is inserted into notches of base bottom plank 2 and sloped bottom plank 3 at the crossover of the two planks. The Biological Benchmark 12 plank sets the margin for emergent plantlife at the interface of land and water. Lower plane plank 13 is set into notches of the sloped bottom plank 3 forming the base perimeter of the topography structure. Earth medium 14 excavated for the placement of the topography structure is replaced between the plank elements. Aquatic vegetation 19 is planted in water between low water 16 and biological benchmark 18. Terrestrial vegetation 20 is planted above highwater line 17. The slope and grade of the earth medium surface is varied at both the upper and lower elevations of the frame structure by varying the angle between the base bottom plank 2 and the sloped bottom plank 3.

Figure 2:
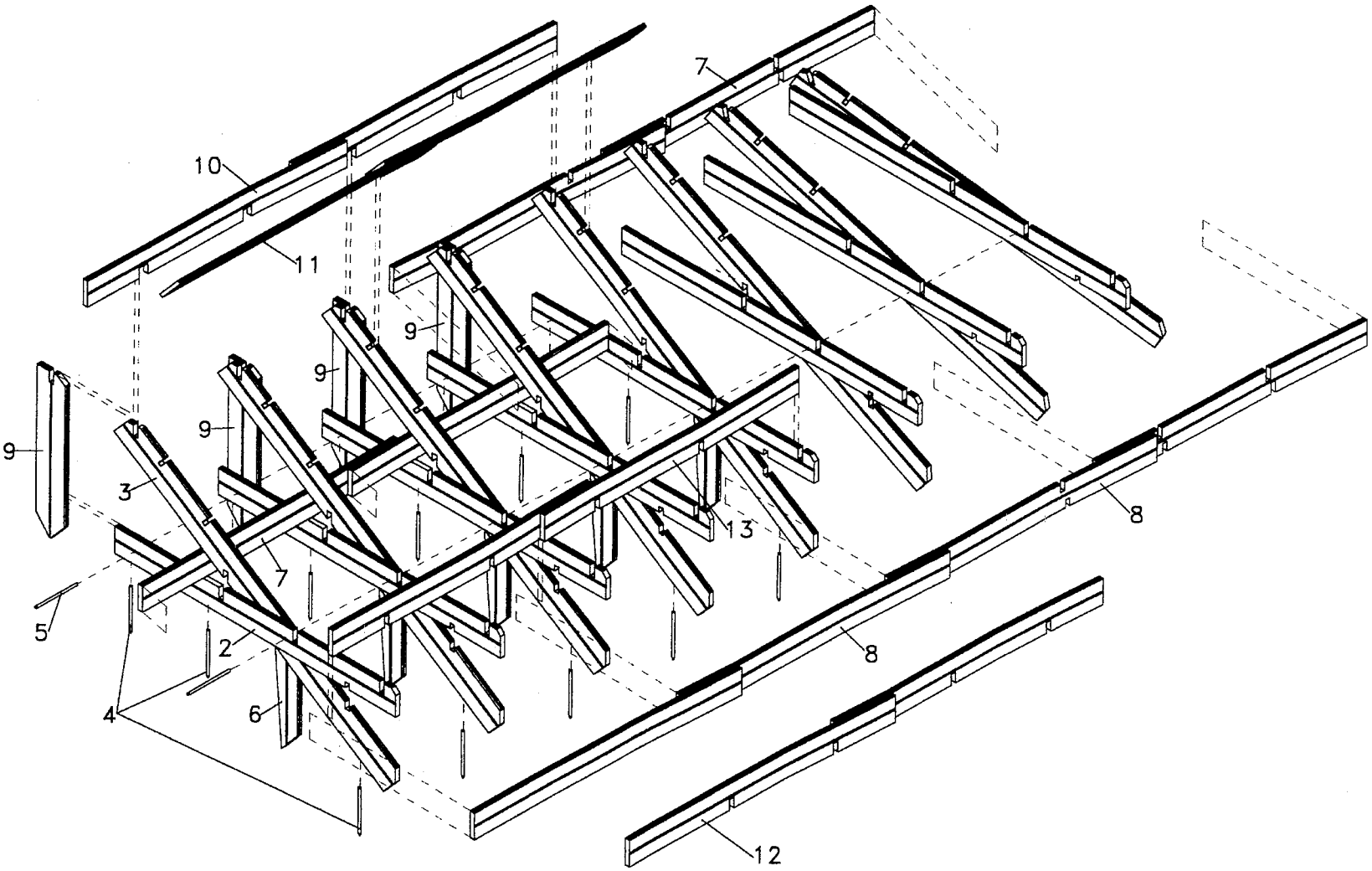
FIG. 2 is a perspective exploded illustration of a representative topography structure.

FIG. 2 shows and exploded view of FIG. 1 with planks separated.

Figure 3:
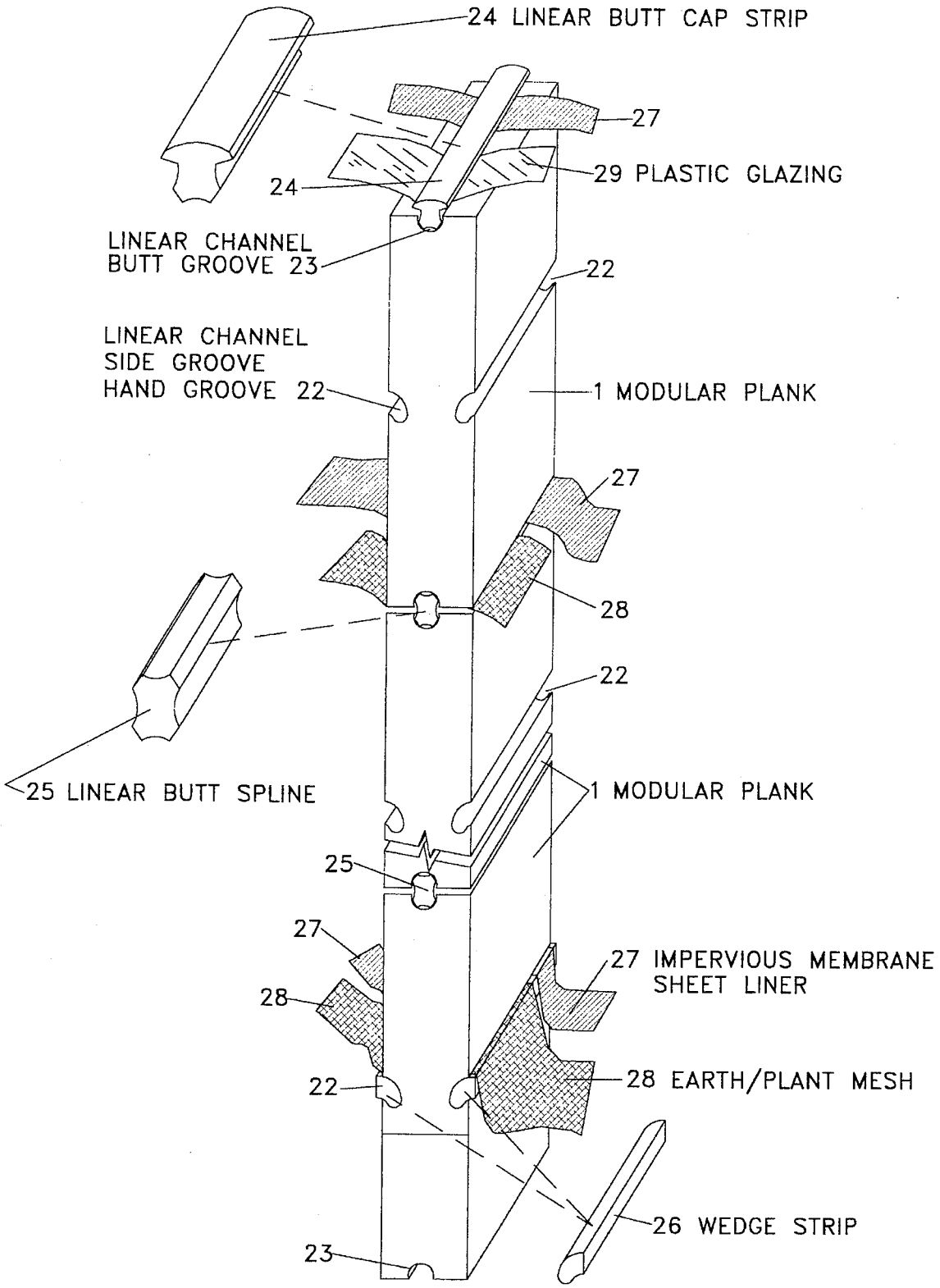
FIG. 3 schematically illustrates details of the modular plank of the system and several of its components.

FIG. 3 is a cross section perspective of the basic modular plastic plank; said plank being approximately, but not limited to, one and one half inches wide. This plank detail is employed in all modules including linear units shown for this patent application. Linear channel side grooves 22 form a continuous uniform recess in the modular plank for retaining at different levels; impervious membrane sheet liner 27, and/or earth/plant mesh 28; with or without wedge strips 26. Side groove 22 also serves as a hand grip to facilitate movement and placement. A continuous and uniform butt groove at the butt ends of modular plank 1 allow for; connection of planks vertically with linear butt spline 25, provide a through joint hold for sheet liner 27, and mesh 28, and a cap recess for placement of plastic glazing 29 and/or sheet liner 27 when fastened with linear butt cap strip 24.

Figure 4:
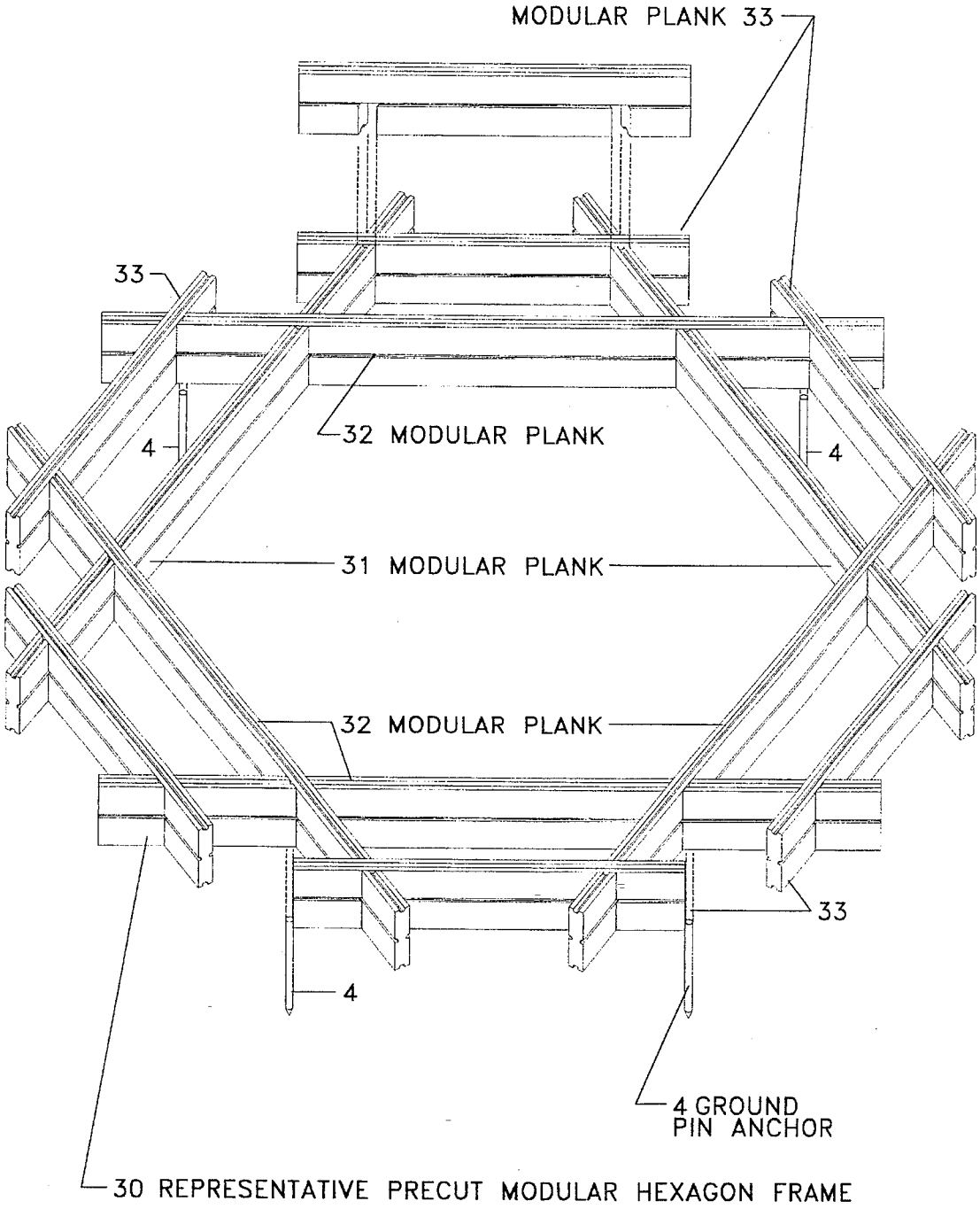
FIG. 4 is a perspective pictorial illustration of a representative hexagon modular frame.

FIG. 4 shows a representative precut modular hexagon frame 30 of self interlocking planks 31, 32 and 33 of standard sizes and notches. The plank at the top of FIG. 4 illustrates the precut notches. Ground pin anchors 4, facilitate layout on the ground and stabilize the placement of the first two planks set in the ground upon which the remainder of the installation will be placed. Modular size may be varied to suit specific requirements, and may vary from seven feet to twelve feet or more across.

The structural members in the module are plastic.

Figure 5:
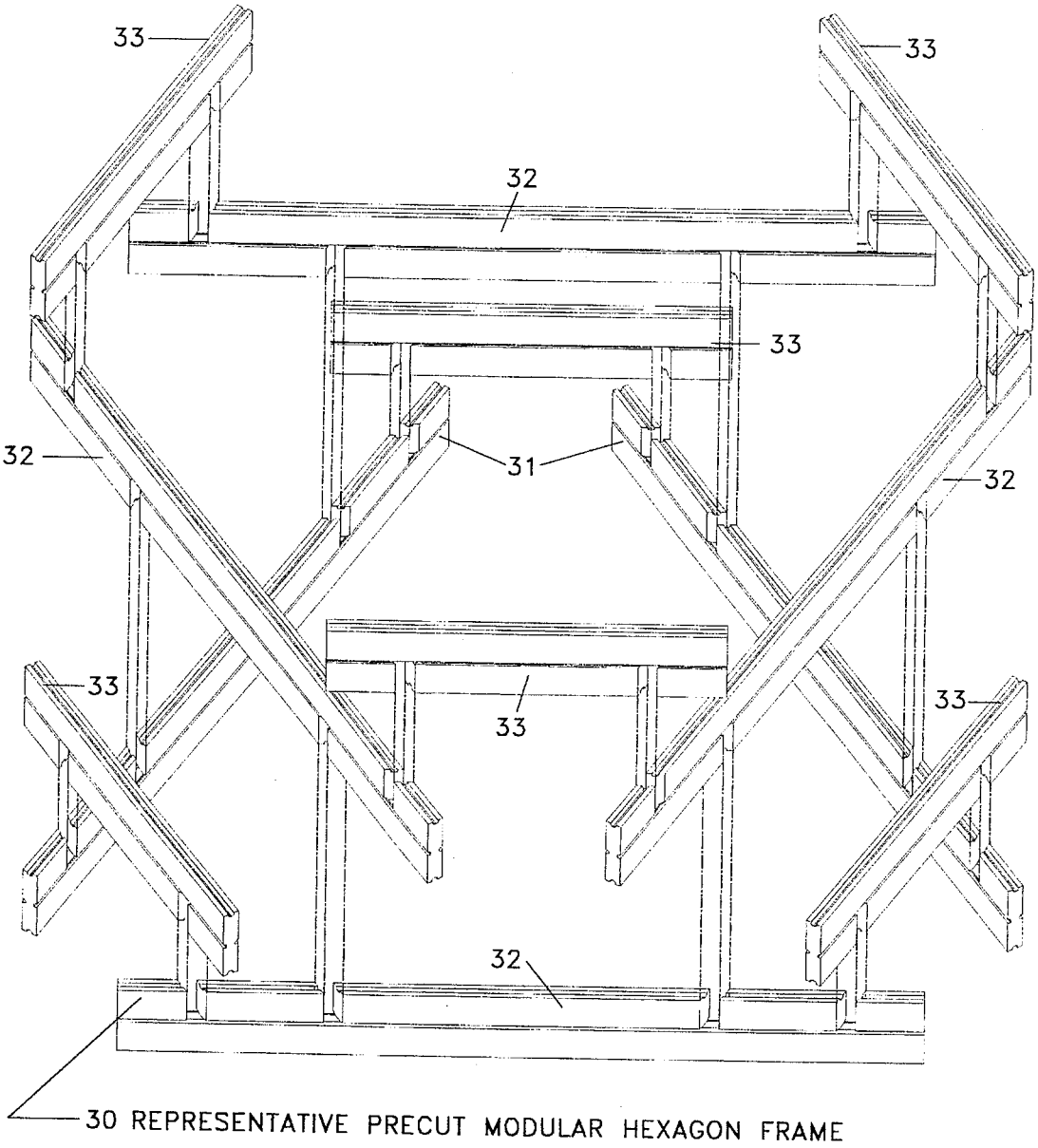
FIG. 5 is a perspective exploded illustration of a representative hexagon modular frame.

FIG. 5 is an exploded view of the representative module frame 30 of FIG. 4 showing interlocking notches of repetitive plank 31, 32 and 33.

Figure 6:
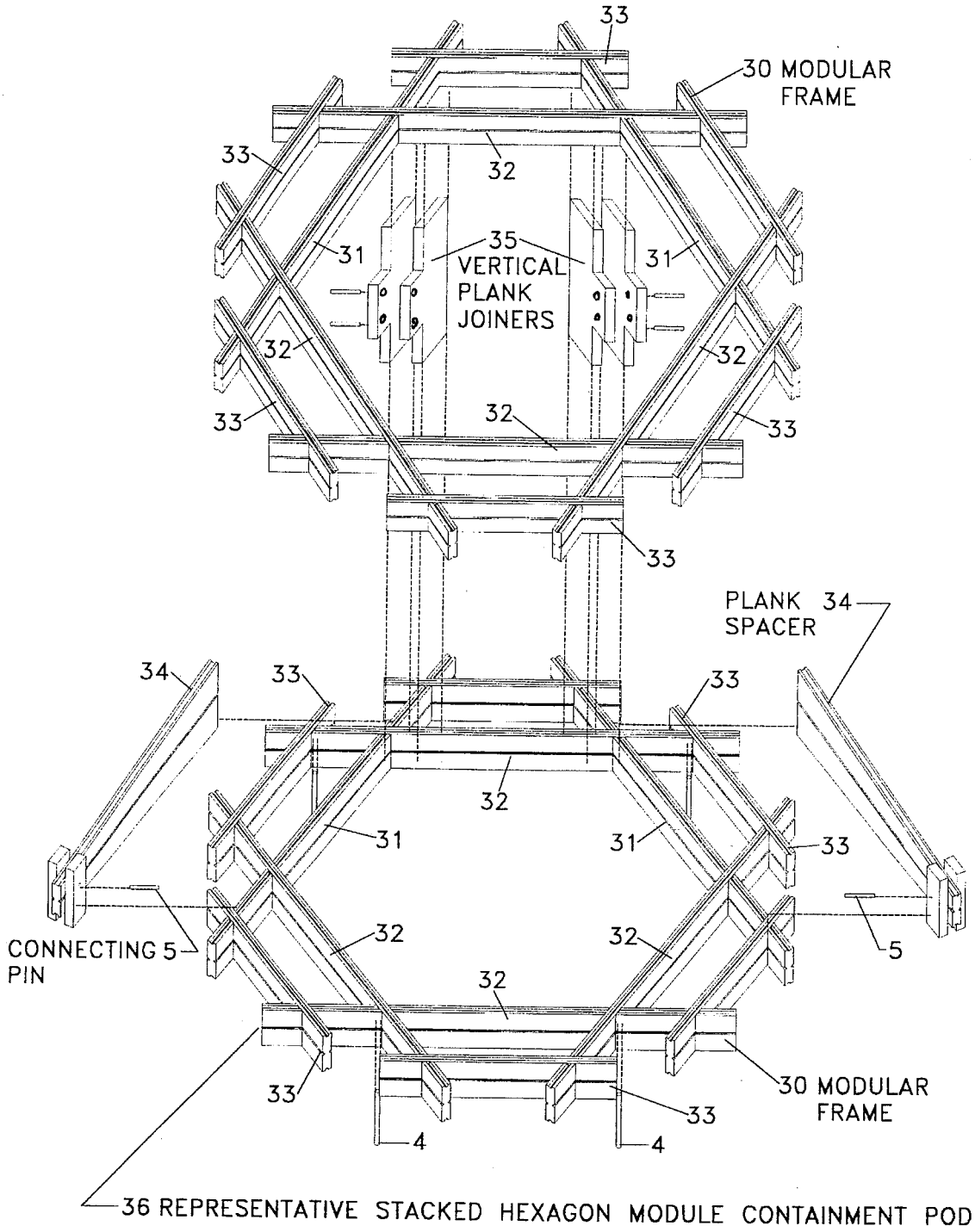
FIG. 6 is a perspective exploded illustration of a representative stacked hexagon pod modular.

FIG. 6 is an exploded view of a representative stacked module 36 consisting of; two modular frame 30, inclined by plank spacer 34 and held in place by vertical locking plank joiners 35.

Figure 7:
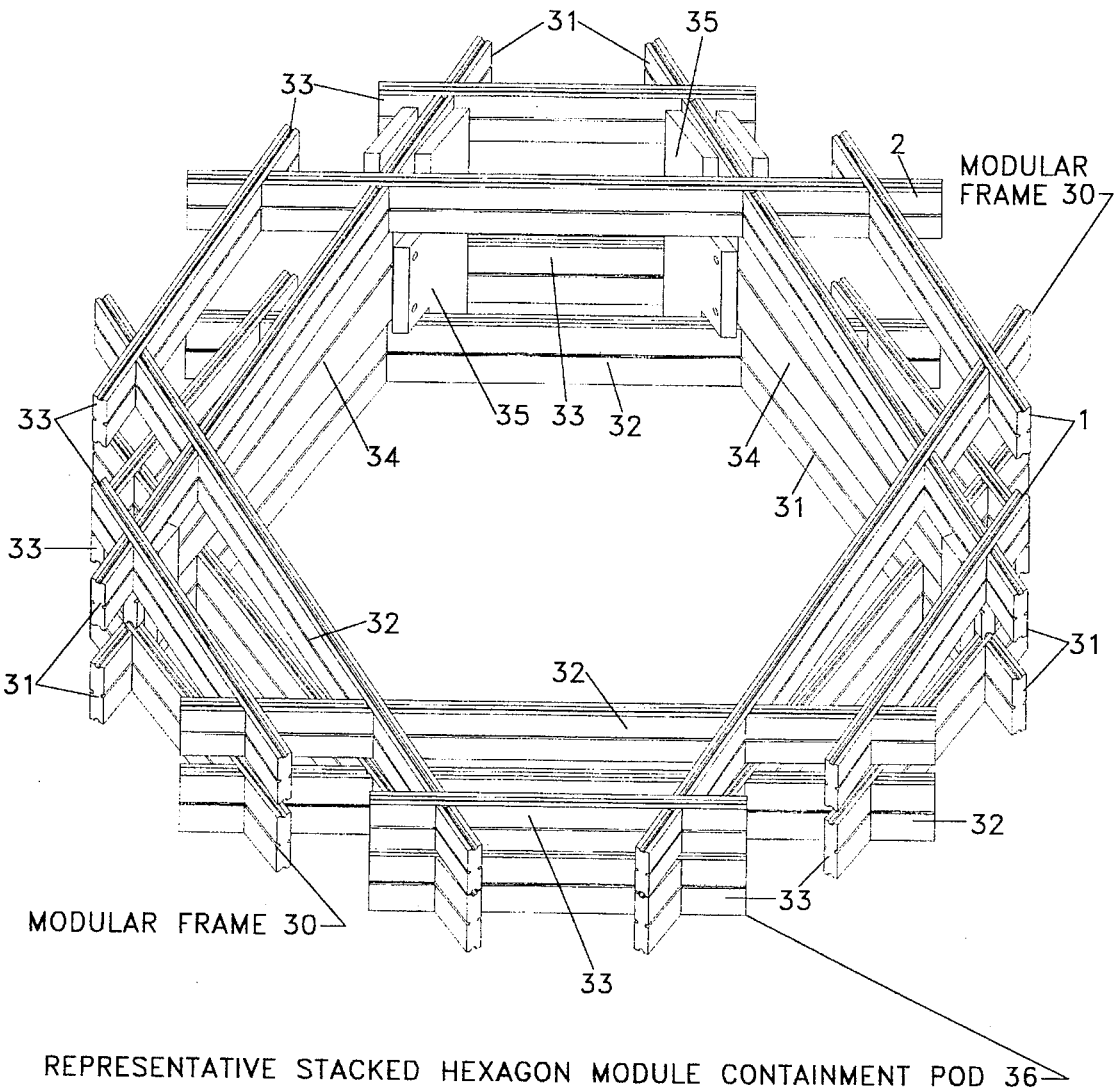
FIG. 7 is a perspective view of an assembled stacked hexagon pod module.
Figure 8:
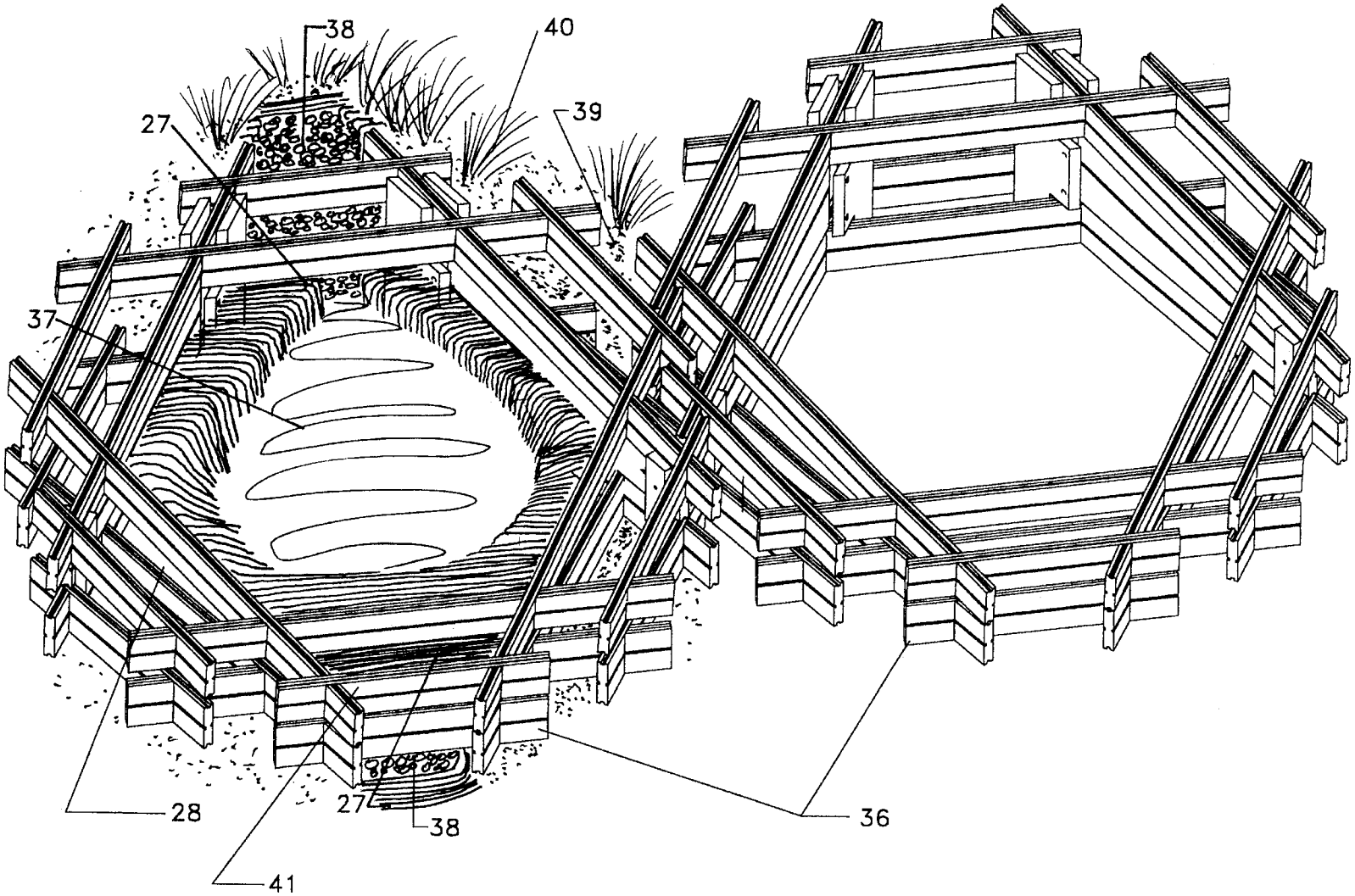
FIG. 8 is a perspective view showing the configuration of built-up pods and an arrangement with liner and plantings.

FIG. 7 shows the stacked hexagon pod module 36 prior to the placement of other elements forming the completed pod as shown in FIG. 8. The upper tier need not be assembled prior to the placement of base fill materials, mesh and/or liner.

FIG. 8 is a perspective of modules partially built-up to a modular environmental pod with liner basin 37 for filtration. The liner basin is not a part of basic erosion control installations. When installed as in FIG. 6 these modules from containment pockets wherein is placed selected soils and plantlife to form a stable, environmentally compatible life sustaining heavy mass three dimensional pod or strip segment, resistant to erosion from moving water. Multiple pods and/or strip segments are connected to form a stable anti erosion contour line and/or bulkhead and/or linear barrier and mechanism for filtration, monitoring and water flow control. The plank spacers 34 and joiners 35 which facilitate stacking of the modules, are shown herein establishing module pitch angle.

Containment stabilized, selected inorganic, sand and gravel 38, and organic soils 39, the medium; support plantings 40, of indigenous and/or compatible species, providing perimeter environment extension including wetland extension and filtration and monitoring of upland waters flowing through; in addition to topography stabilization view root action.

Three dimensional pocket patterns allow for the placement of combinations of; selected soils, root sustainable earth/plant fabric mesh 28, of environmentally benign biologically stable material, polymers and plantlife which when combined and/or singularly employed provide degrees of purifying filtration for runoff water passing through from adjacent higher land prior to said water reaching jurisdictional wetlands and/or waterways and lands requiring erosion control. The pockets when lined with sheet liner 27 fastened into side groove 22 or by linear butt spline 25 at different levels to allow treated water channelling, to provide the filter basin 37 for filtering, chemical separation and runoff monitoring. The pockets lined or unlined hold in place earth medium and plant mass, providing perimeter stability during filter maintenance, replenishment and/or replacement.

Assembly is with repetitive use of four or six basic components respectively to construct the pod or linear barrier shore/wetland stabilizer. Assembly is with simple hand tools, a mallet, and without special skills at low cost by; landowners, landscapers and/or construction personnel. A hand post hold digger may be used to set the guide posts.

Figure 9:
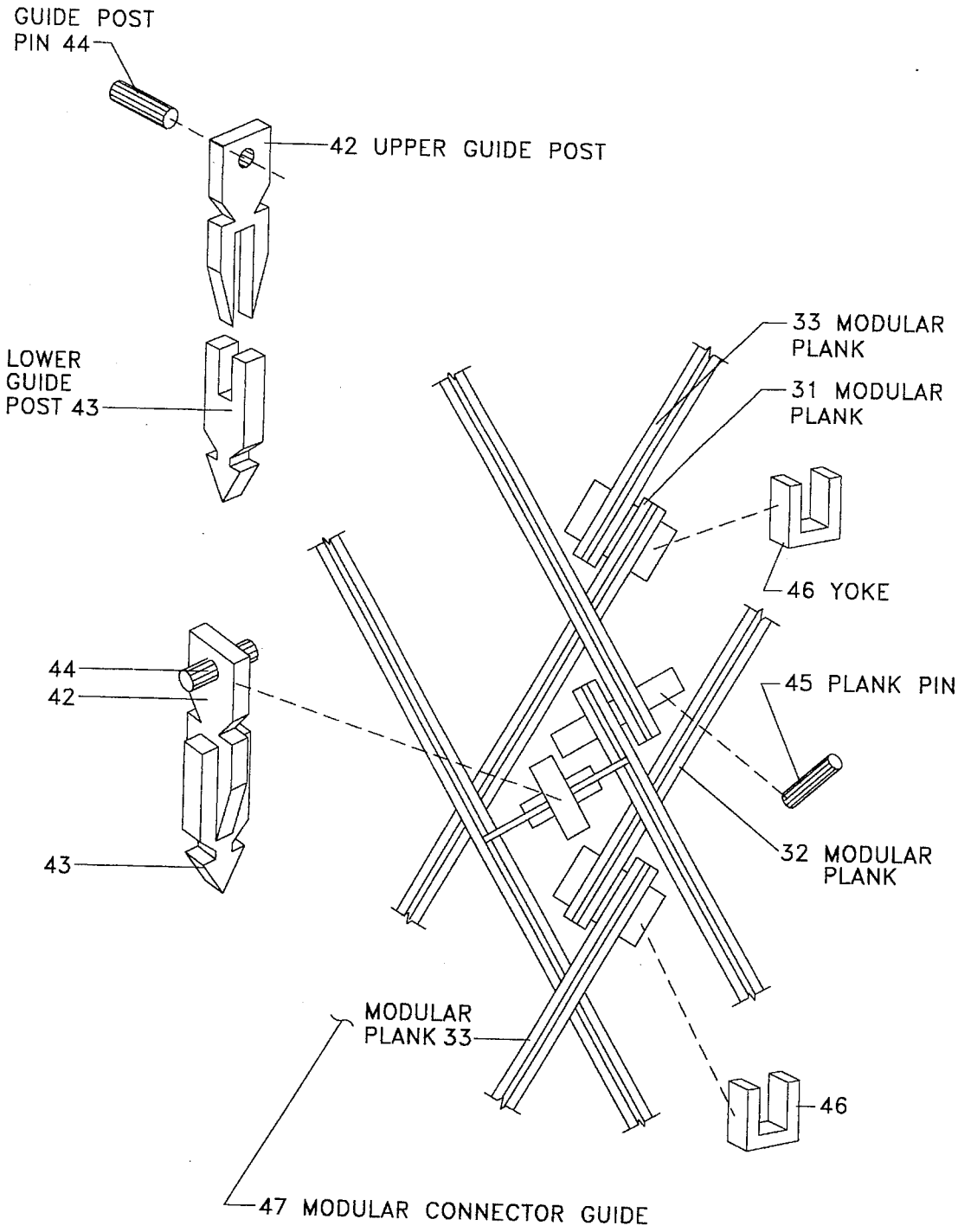
FIG. 9 is a plan view of modular connector details and ground guide posts.

FIG. 9 is a plan view of modular connector guide 47 showing components thereof in exploded view adjacent to and referring to the plan. Lower guide post 43 is placed into a hole in the ground at a point designated for the modules' location. The upper guide post 42 is placed into the lower guide post 43 and the hole is filled with soil, the post position establishes the module location and serves as a construction hold-down for the module during placement employing guide post pin 44. Planks are then connected with plank pin 45 and perimeter planks from adjacent modules are held together with yoke 46. The connection with the modular connector guide 29 are covered with earth medium when the adjacent modules are in place.

Figure 10:
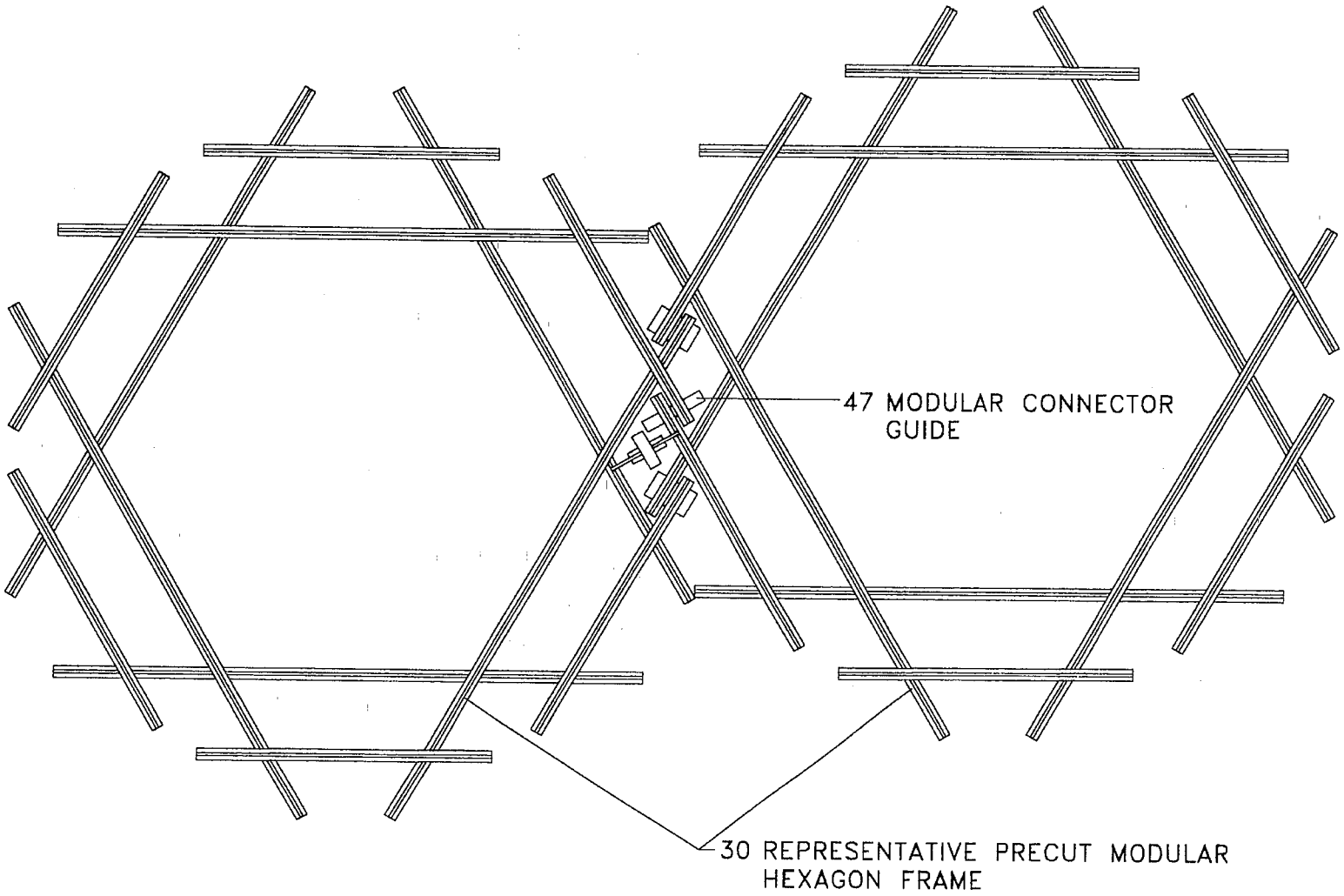
FIG. 10 is a plan view of hexagon modules with modular connector guide.

FIG. 10 is a plan view of two modular frame 30, joined with modular guide 47.

Figure 11:
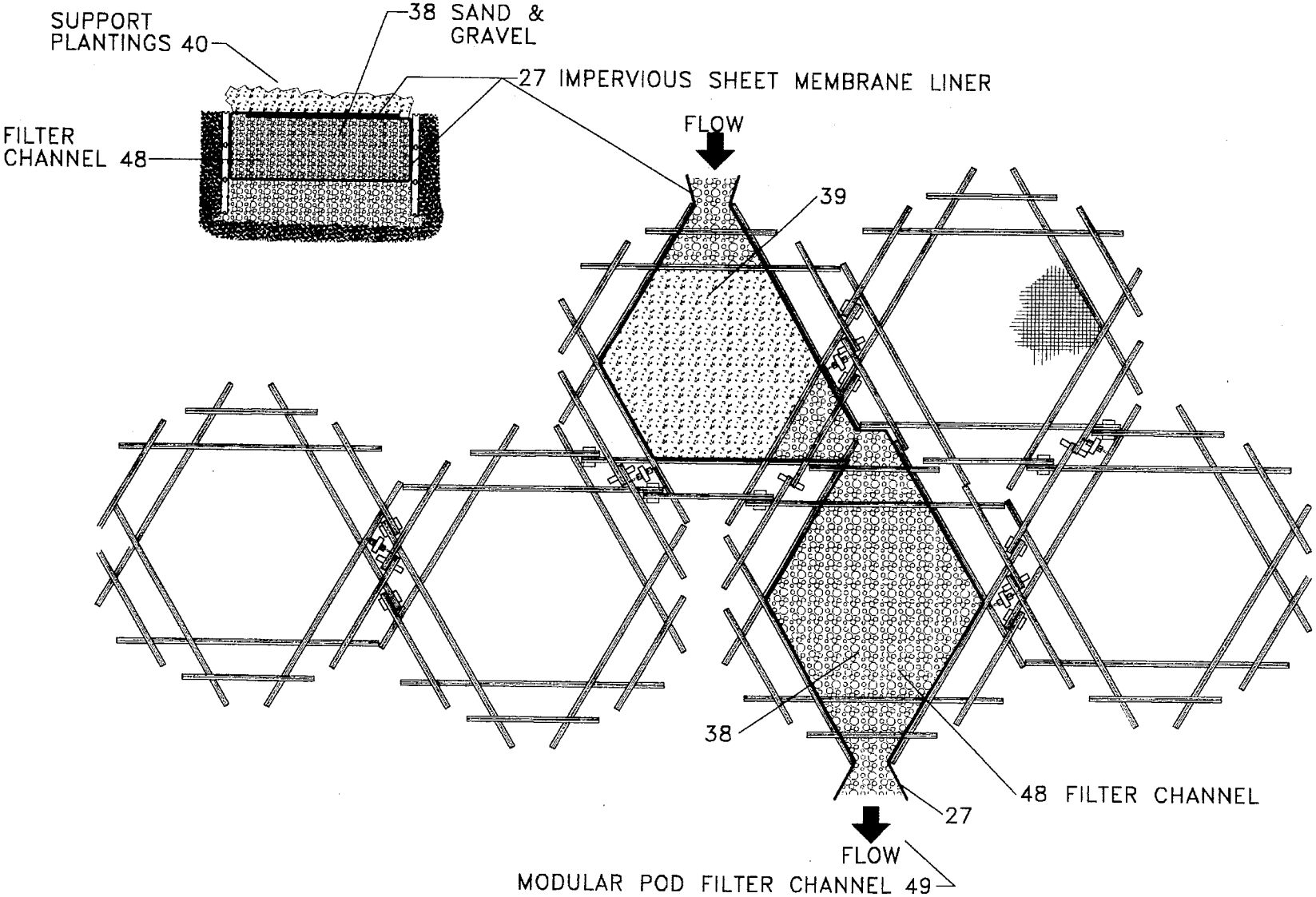
FIG. 11 is a plan view of multiple pod frames, showing a filter channel arrangement.

Multiple pods may be arranged as illustrated in FIG. 11 to provide filter channels 49 or other forms of extended surface for water treatment.

FIG. 11 Shows controlled channelling of water by gravity through the shore/wetland stabilizer system for filtering and monitoring is accomplished by placement of the sheet liner in a channel provided by adjacent plank surfaces, the liner base resting on the earth medium bed below and side pressed into the perimeter plank. The sheet liner is extended upward from the linear connection to the perimeter and then folded over added gravel fill, porus earth filtration material and/or packaged filtration material of recycled glass, glass and other materials; and/or monitoring material, said filler forming the channel cross section, flow turbulence, energy and velocity characteristics and intended use within the sheet liner surround; stabilized by the plank surround and continuous connection to the planks, said perimeter assembly also retaining the rubber positioning when the channelling is removed or cleaned during maintenance replacement and/or observation. Gravity flow channelling is made flexible within all perimeter wall patterns using the continuous extruded linear groove and wedge strip system. The flow is controlled by the dimensional characteristics of the mass employed for the channel fill. Channels may be incorporated into all types of modular plank frames including but, not limited to linear and hexagon configurations shown herein.

Figure 12:
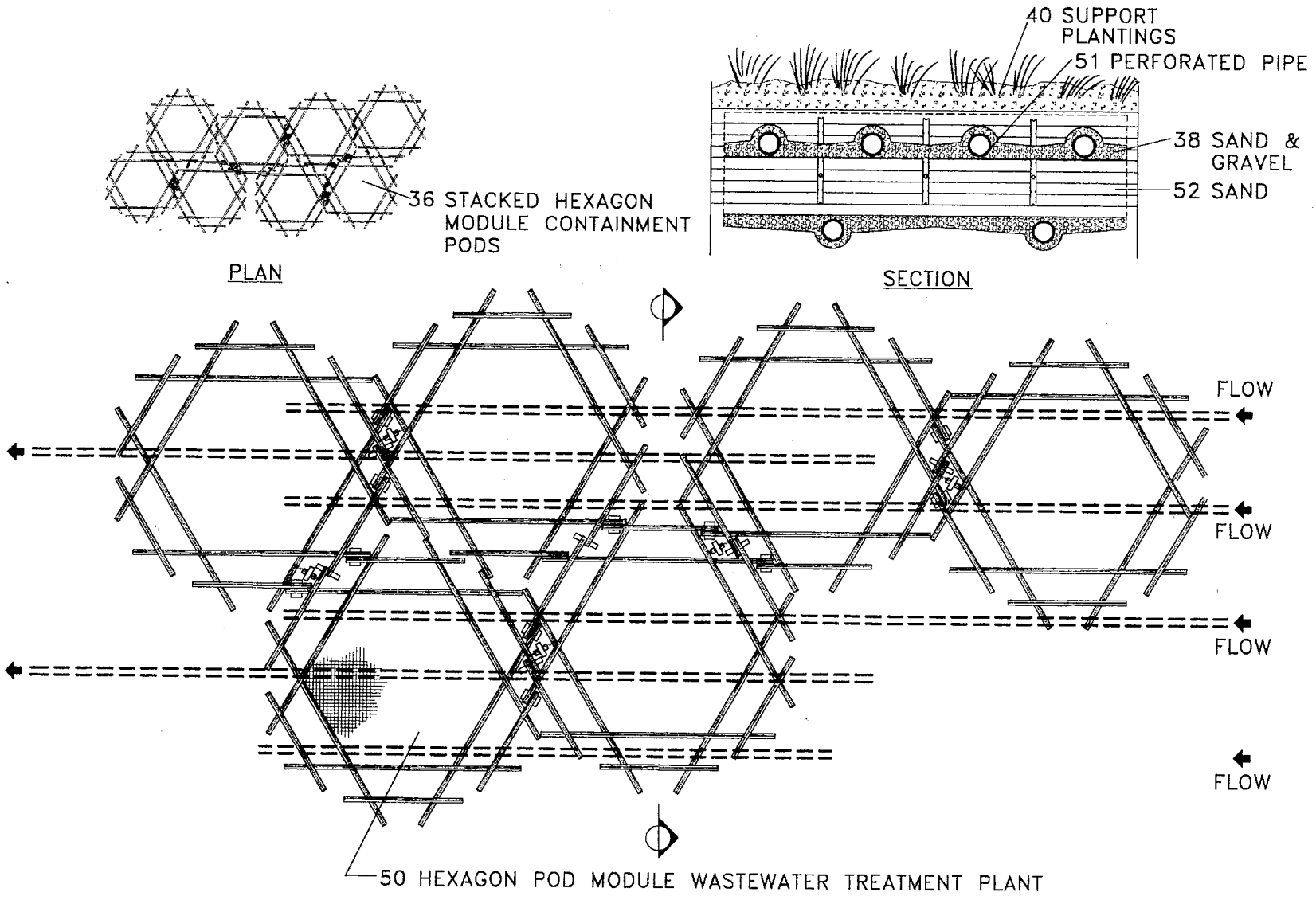
FIG. 12 is a schematic plan of a typical pod chain utilized in a waste water sand filter system.

FIG. 12 shows a wastewater disposal system is created using pods in series with channel flow directed to conform to site conditions.

Controlled plant growth and bacterial containment systems for monitored nutrient water hydroponic, semi-hydroponic and selected earth growth are created using pods in series with channel flow directed with continuous uninterrupted sheet liner channels of alternative depth and width. Multiple pods may be employed in chain-like arrays in sand filter waste systems, FIG. 10, and similar applications which employ water quality industry accepted methods of water treatment and purification for the reduction of "Nutrients," toxics and biological oxygen demand for upgrading unacceptable runoff water and wastewater before its introduction into the surrounding natural environment.

Where modules are installed in multiple arrays, the modular connector guide 47 of posts 42, 43, pins 44, 44 and yokes 46 or similar systems are used to layout and connect adjacent modules, while accommodating relative movement of the modules due to soil movement. Pods may be used for dune and soil stabilization, as shown in FIGS. 13 and 14.

Figure 13:
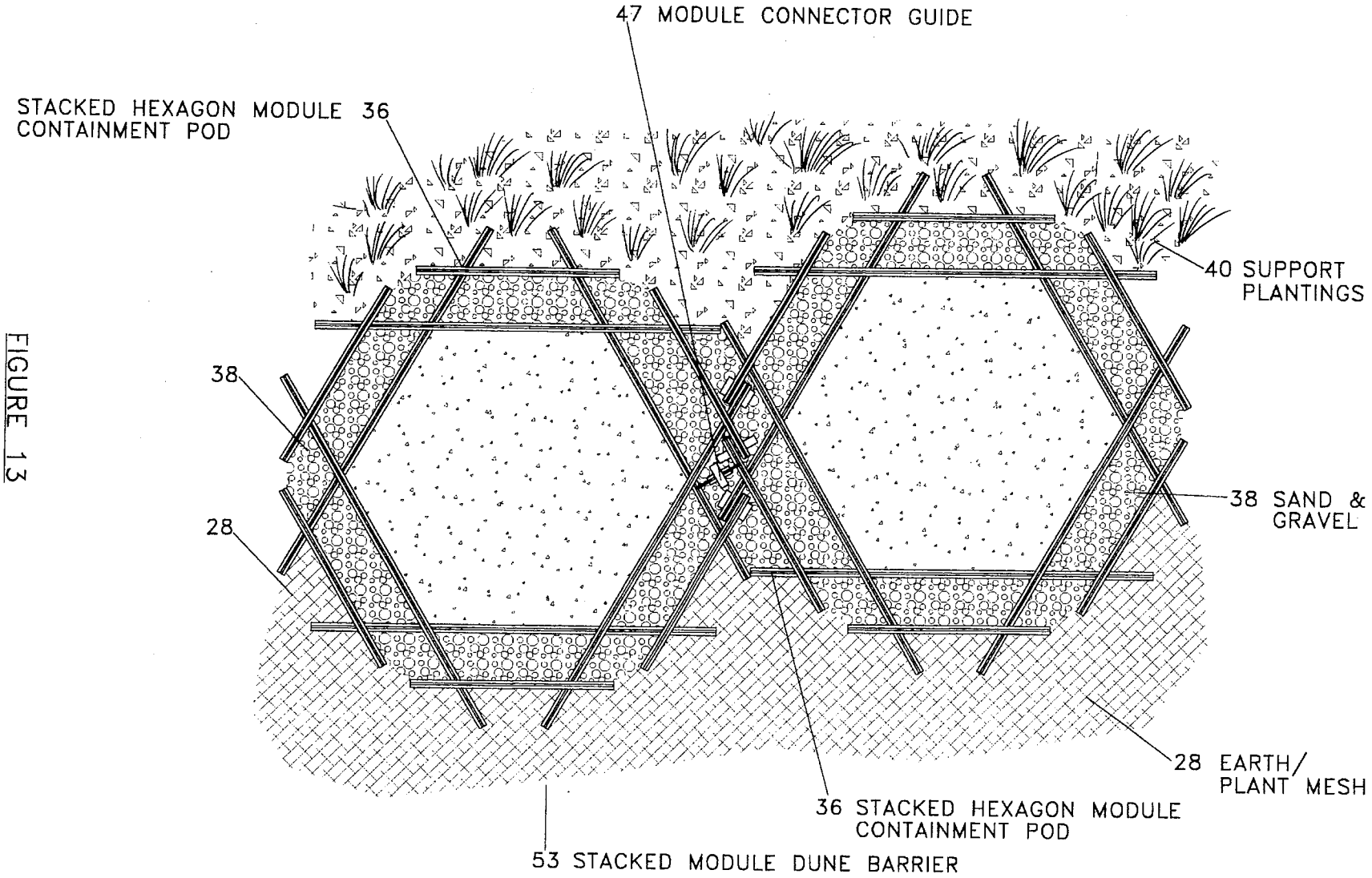
FIG. 13 is a plan of two built-up pods used as a dune barrier.

In the arrangement of FIG. 13, gravel 38 fills the perimeter voids of each pod and anchors the assembly, and plank drainage spacers 79 are installed to permit free drainage through the assembly.

Figure 14:
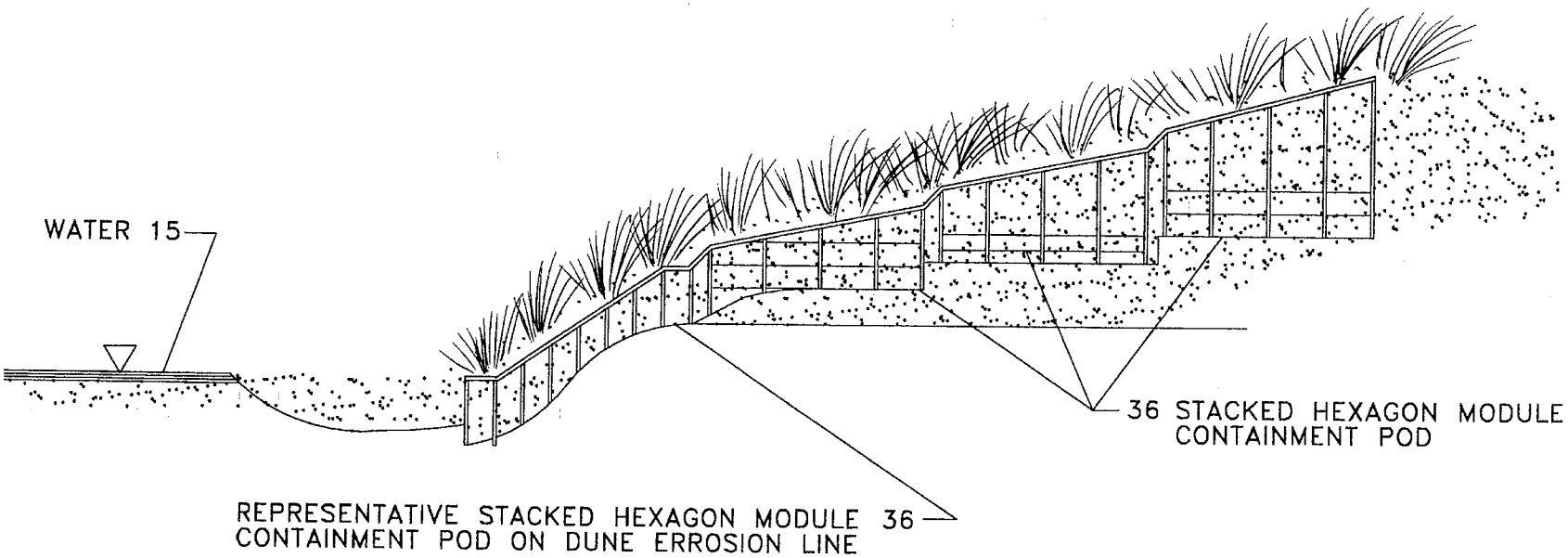
FIG. 14 is a section view of built-up pods-used as a dune barrier.

Stacked hexagon pod modules 36 may be used to build up eroded lands, including dunes, as illustrated in FIG. 14. Illustrated are the water 15, shoreline and the filled modular frames 36, built-up over the erosion failure profile line at the base of frames preventing rotational outward slide as found in the Swedish Curve.

The inherent flexibility of this invention supports a variety of basic designs, configurations, and combinations of features, to best suit differing applications, terrain, and criteria.

Figure 15:
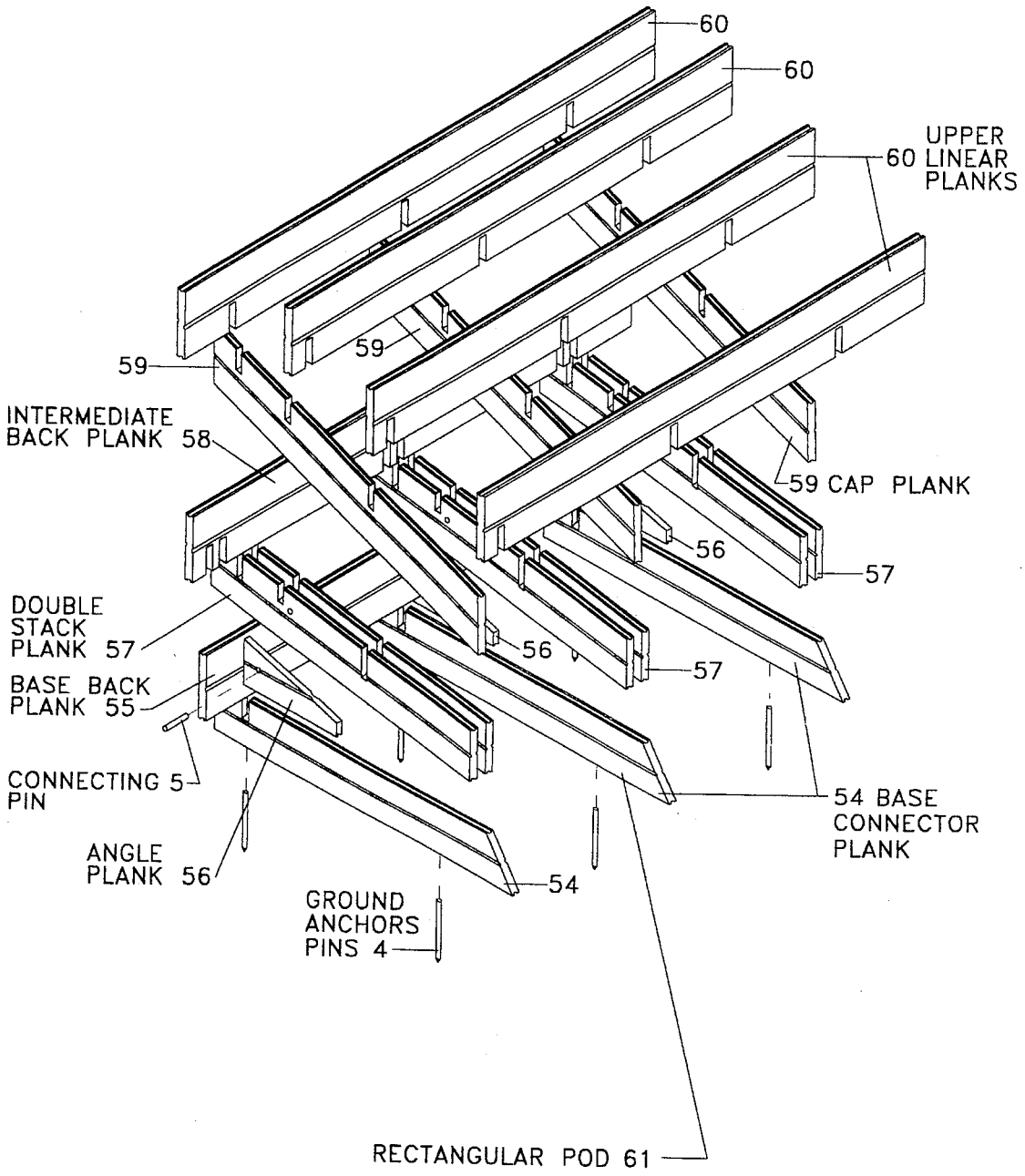
FIG. 15 is an exploded view of the pod system, in a rectangular array.

FIG. 15 is an exploded view of a rectangular configuration for linear placement. Rectangular pod 61 is formed by the measured placement of base connector planks 54 utilizing pin anchors 4. Back plank 55 is continuously set into the mating slots of the base connector plank 54. The angle of the pod is established by the angle of angle plank 56 placed on base connector plank 54 and upon which is placed double stack plank 57. The remainder of the pod is formed by the interconnecting stacking of intermediate back plank 58, cap plank 59 and upper linear plank 60 of varying lengths lapping joints; completing rectangular pod 61. The basic plank component is representative, modular plank 1 shown in FIG. 3.

Figure 16:
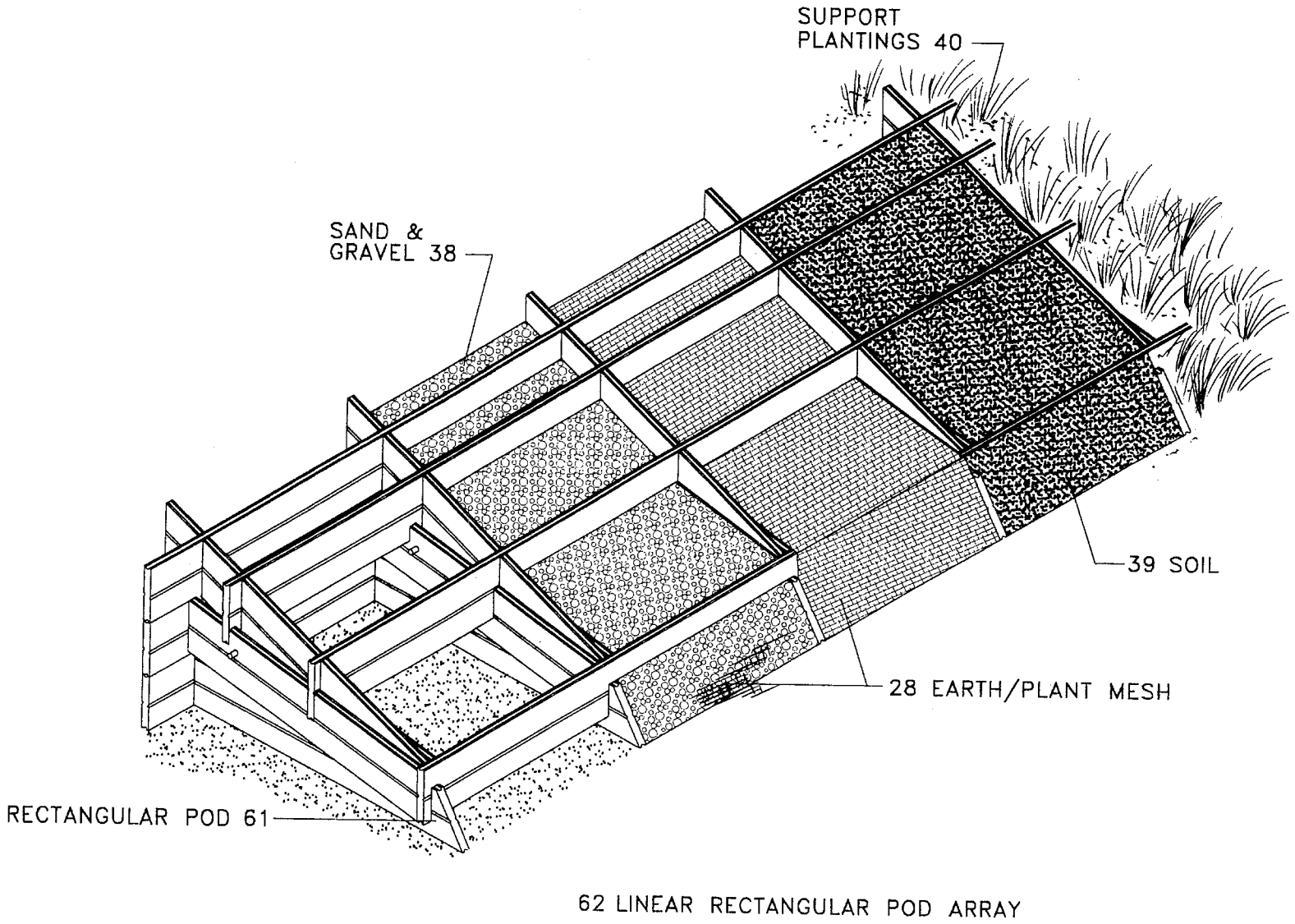
FIG. 16 is a perspective view of the basic modules forming a continuous straight linear barrier, with plantings.
Figure 17:
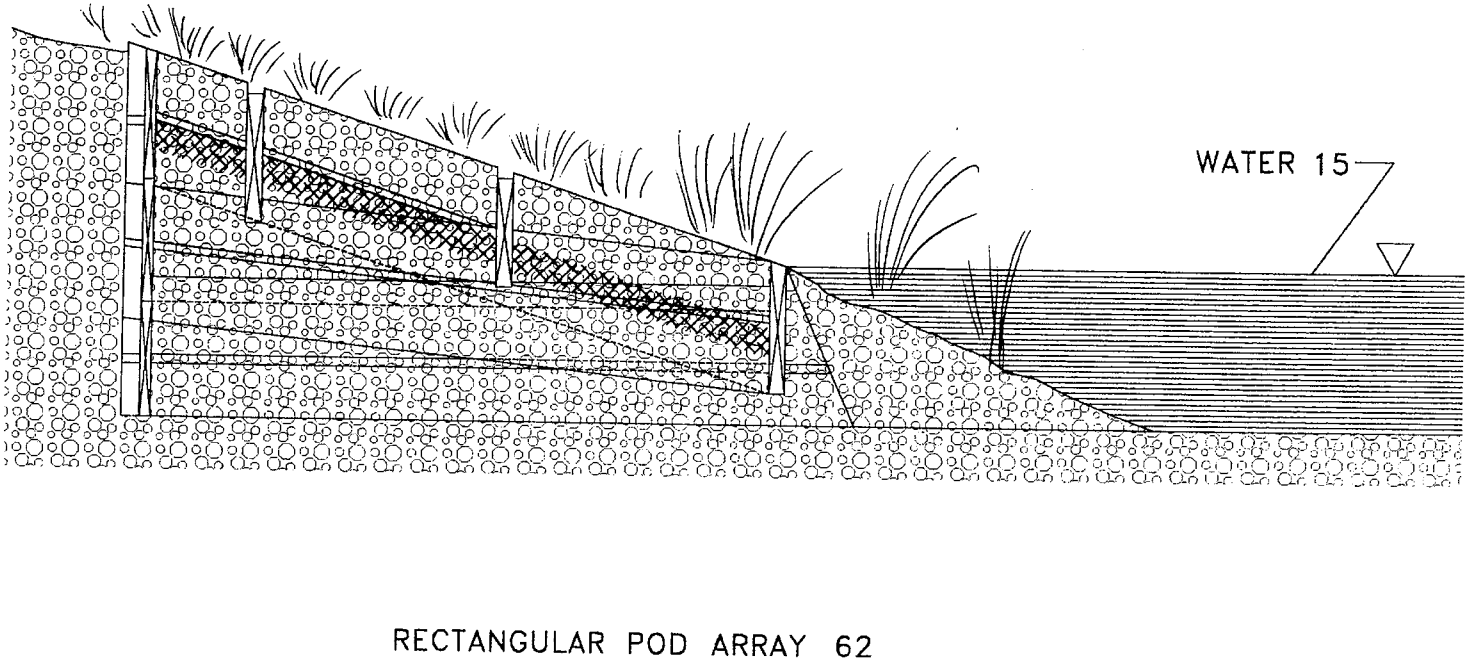
FIG. 17 is a section of a typical module.
Figure 18:
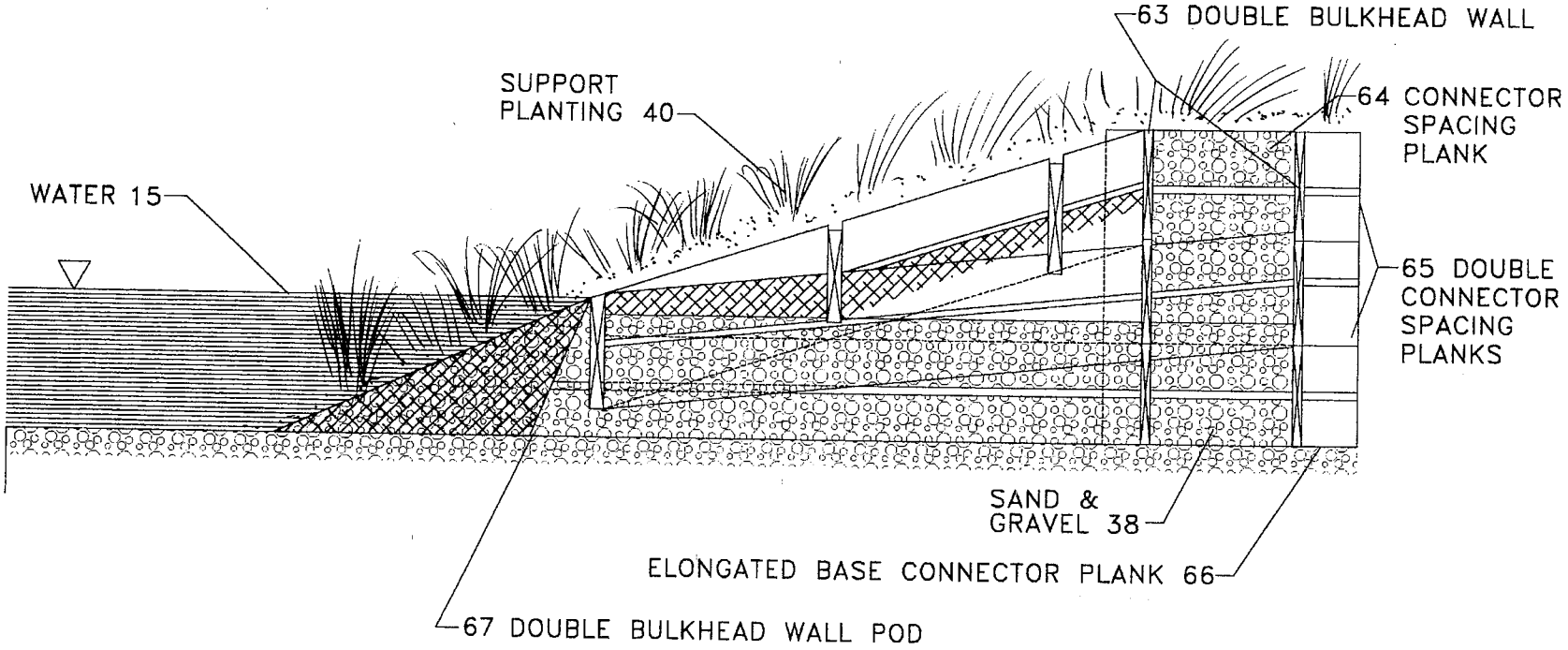
FIG. 18 is a section showing a double bulkhead wall on the upland side.

A rectangular array of modules is shown in place on a straight shoreline in FIG. 16 and in section view in FIG. 17. FIG. 18 is a section view of the modules in a double bulkhead 63, formed by the addition of a connector spacing plank 64, double connector spacing planks 65, elongated base connector plank 66, the pocket formed to the land side is filled with gravel 38 or other heavy material to provide stabilization.

Figure 19:
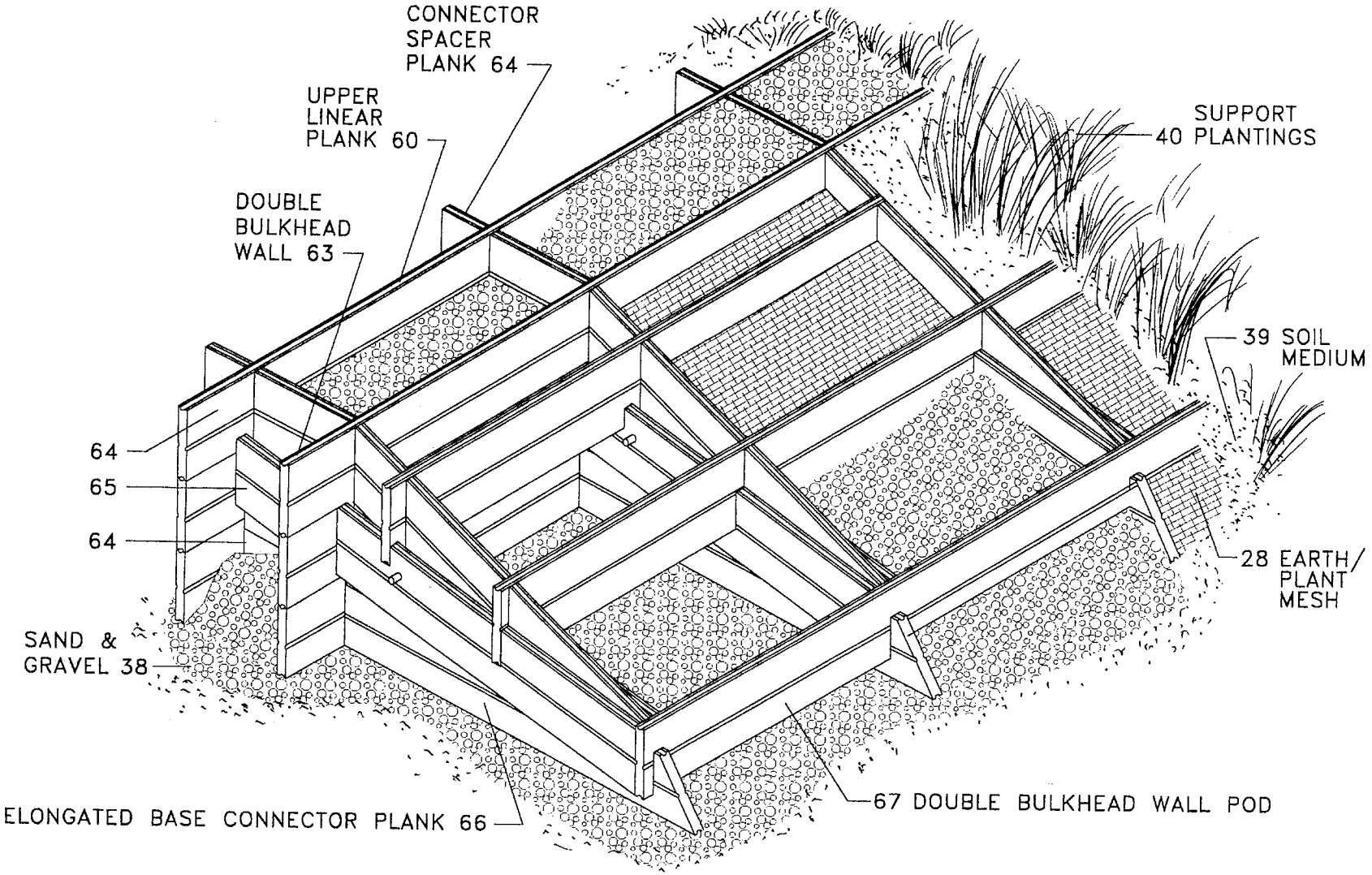
FIG. 19 is a perspective of a double bulkhead wall on the inland side.

FIG. 19 illustrates the double bulkhead wall configuration in isometric showing gravel 38, planting 40, and mesh 28 set in a soil medium 39.

Figure 20:
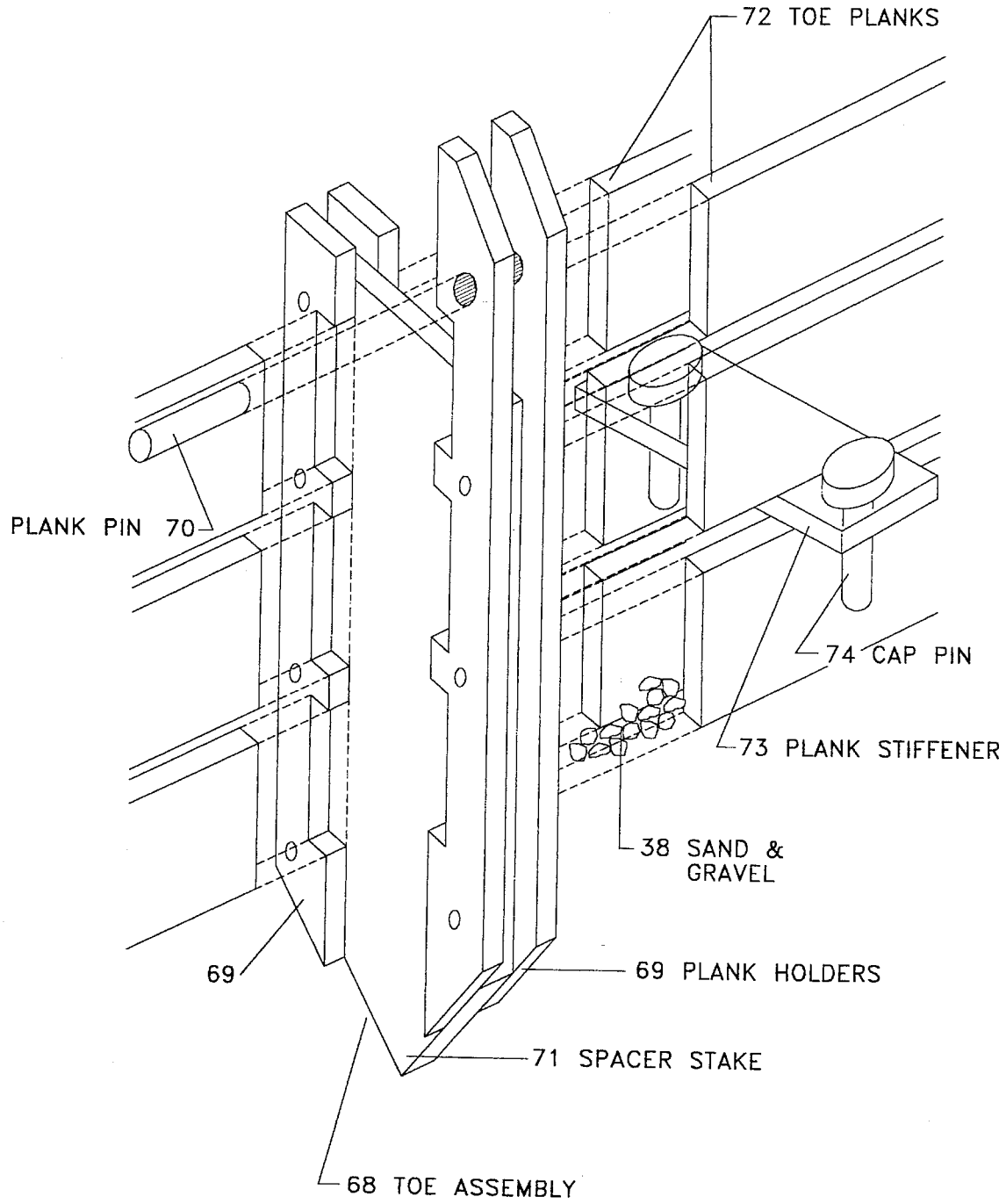
FIG. 20 is a perspective of a toe assembly detail exploded view.

FIG. 20 illustrates toe assembly elements in exploded view to form a seaward toe assembly 68 for the modular pod. Space stake 71 with plank holders 69 attached with plank pin 70 is set into a trench to receive double toe planks 72, stiffened with plank stiffener 73, secured with cap pin 74.

Figure 21:
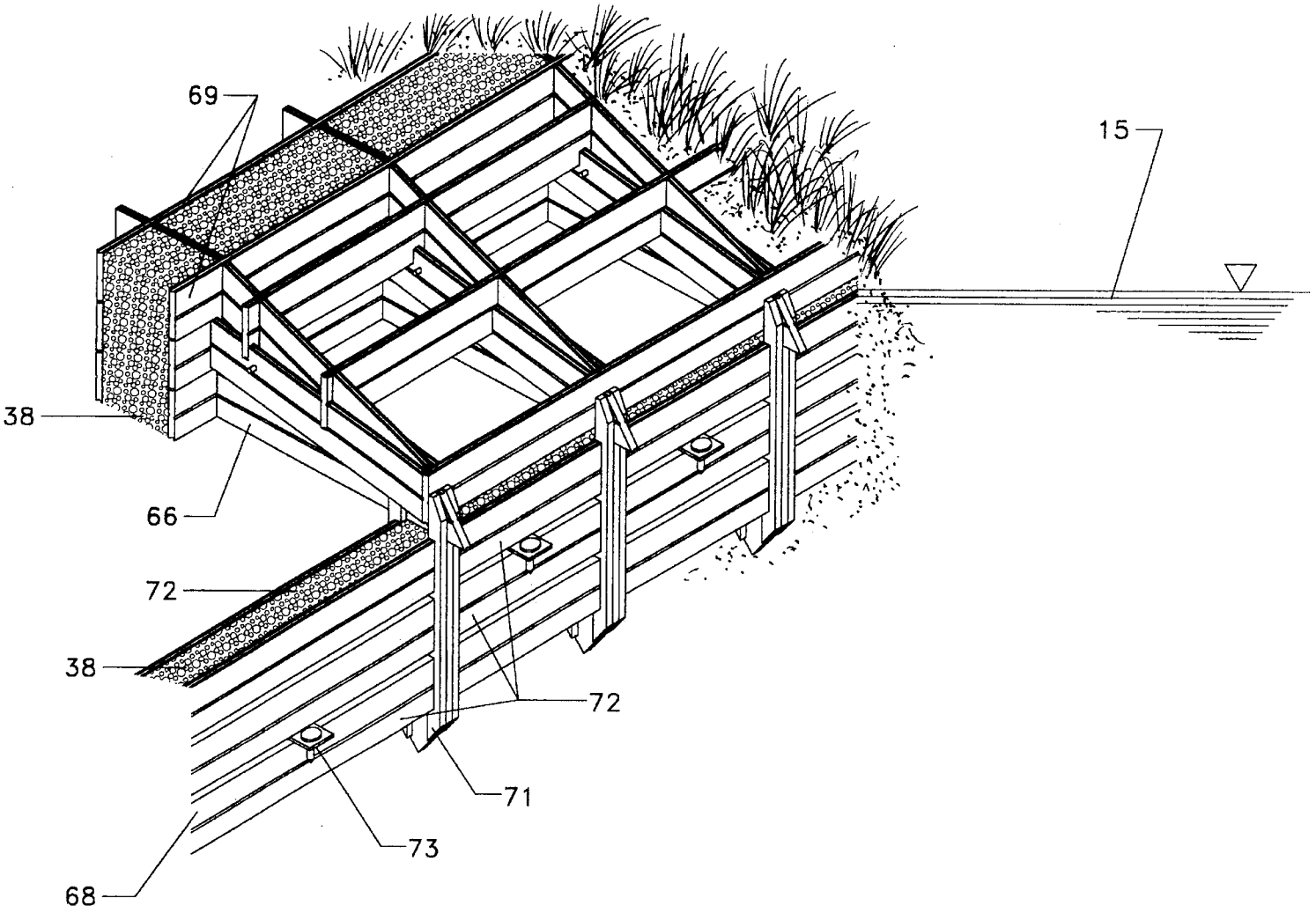
FIG. 21 is a perspective of shore linear barrier with gravel filled double bulkhead and toe assembly.

FIG. 21 is a perspective view of the rectangular pod with double bulkhead wall pod 67 and toe planks 72, with toe assembly 68 filled with a ballast of gravel 38, for stabilization below water 15, when back filled to the top toe plank 72.

Multiple bulkheads and toe walls may be provided.

Figure 22:
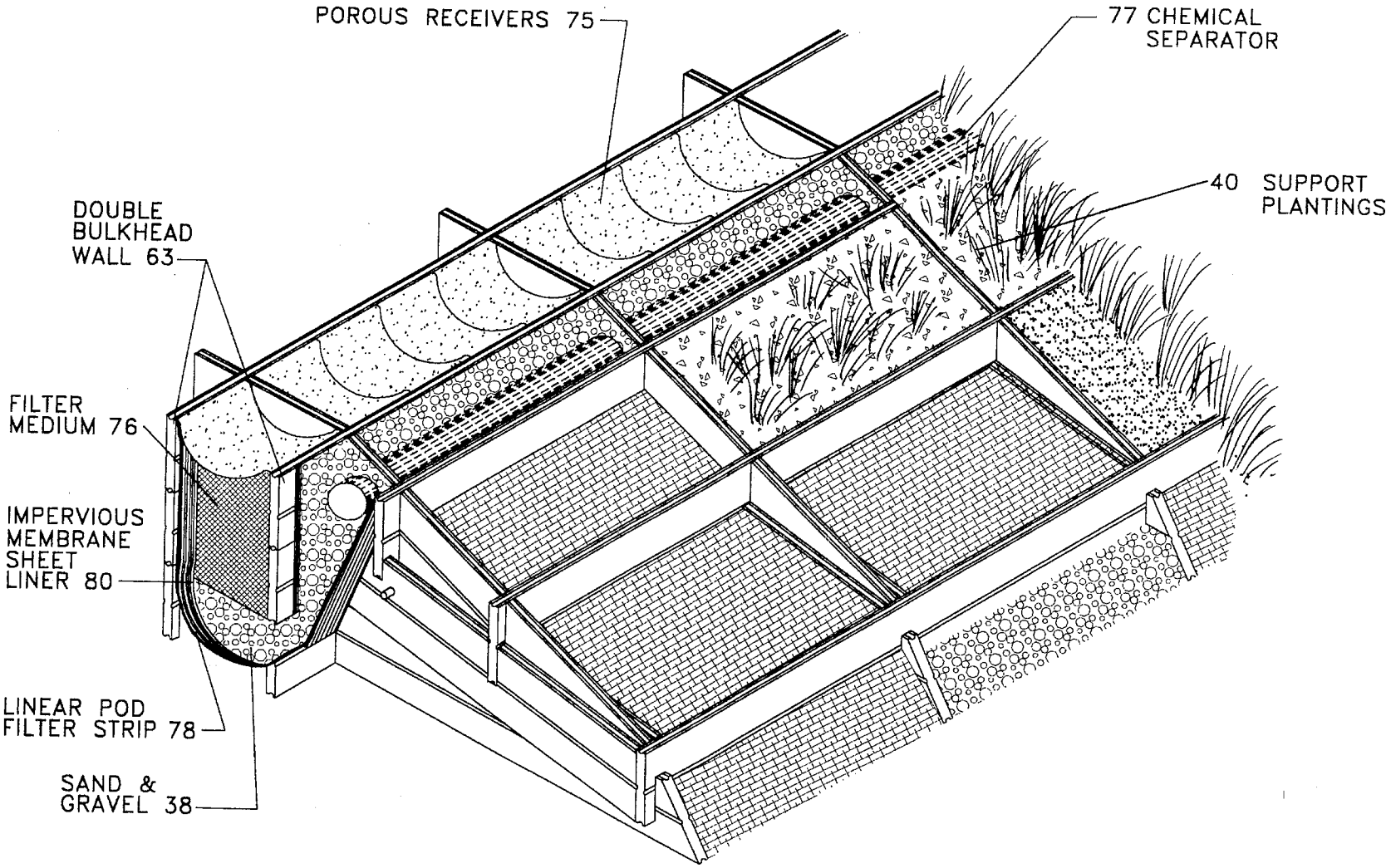
FIG. 22 is a pictorial illustration showing runoff receivers with pods used for filtration as linear pod filter strip.

FIG. 22 is a section of double walled shore linear barrier showing premade removable porus cementitious environmentally benign runoff receivers 75 into which surface waters flow and are allowed to flow into filter and/or chemical/oil separator 77 contained by impervious sheet liner 80, which is contoured and supported by gravel 38. The water rises through said gravel to a second filter and/or chemical/oil separator 77 as stabilized by the linear framed plantings. Local or remote monitoring may be provided. A linear pod filter strip 78 is thus formed into the environment perimeter.

Figure 23:
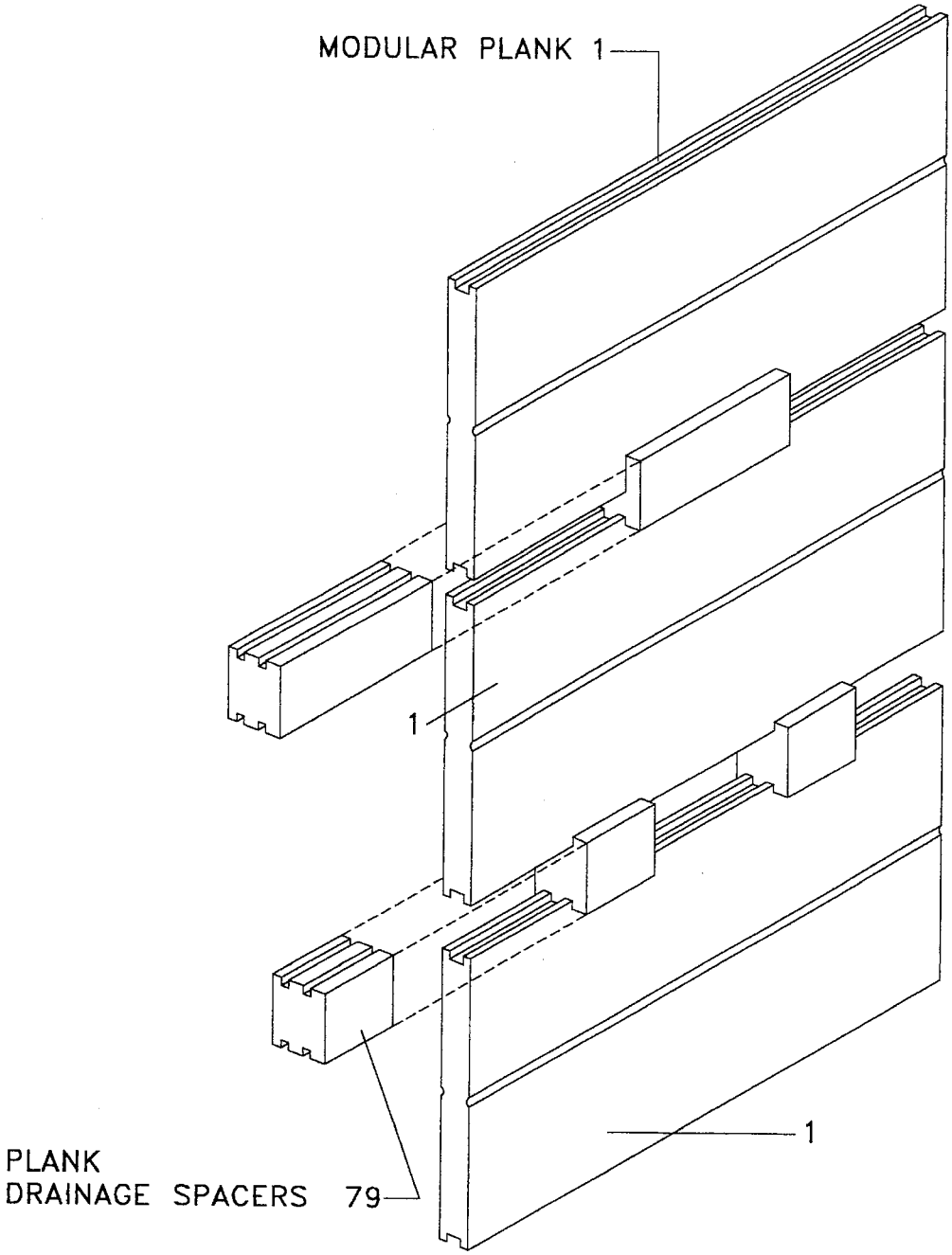
FIG. 23 shows drainage spacers for fully drained structures.

FIG. 23 is an isometric exploded view of drainage spacers 79 formed of environmentally benign plastic for providing spacers between stacked planks wherein-drainage can be provided to relieve hydrostatic pressure.

Figure 24:
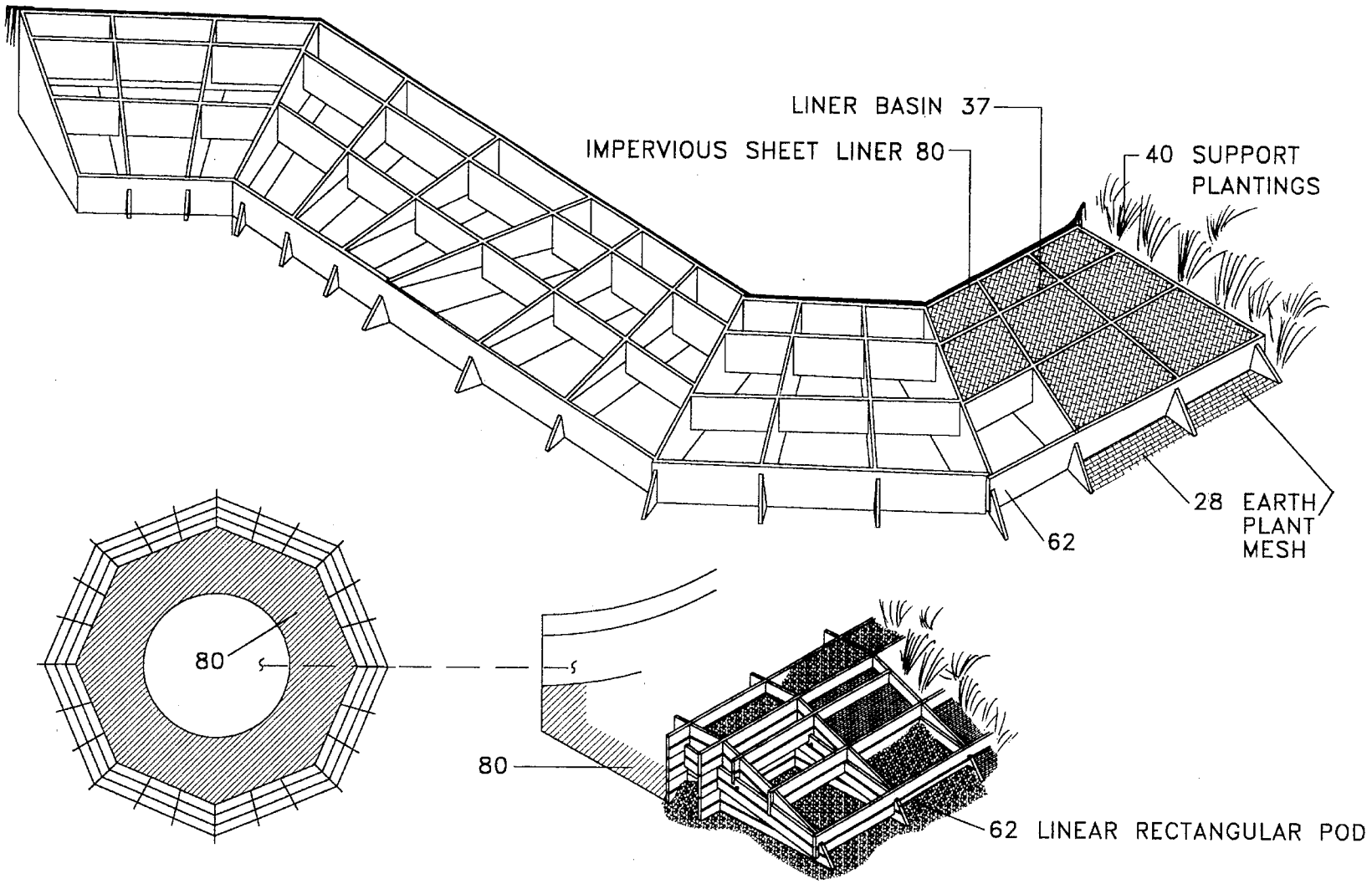
FIG. 24 shows modules used as a chemical storage spill containment bulkhead.

FIG. 24 illustrated the system in use as a bulkhead around a chemical catchment area, and shows the use of the impervious sheet liner 80 to contain spilled material.

Figure 25:
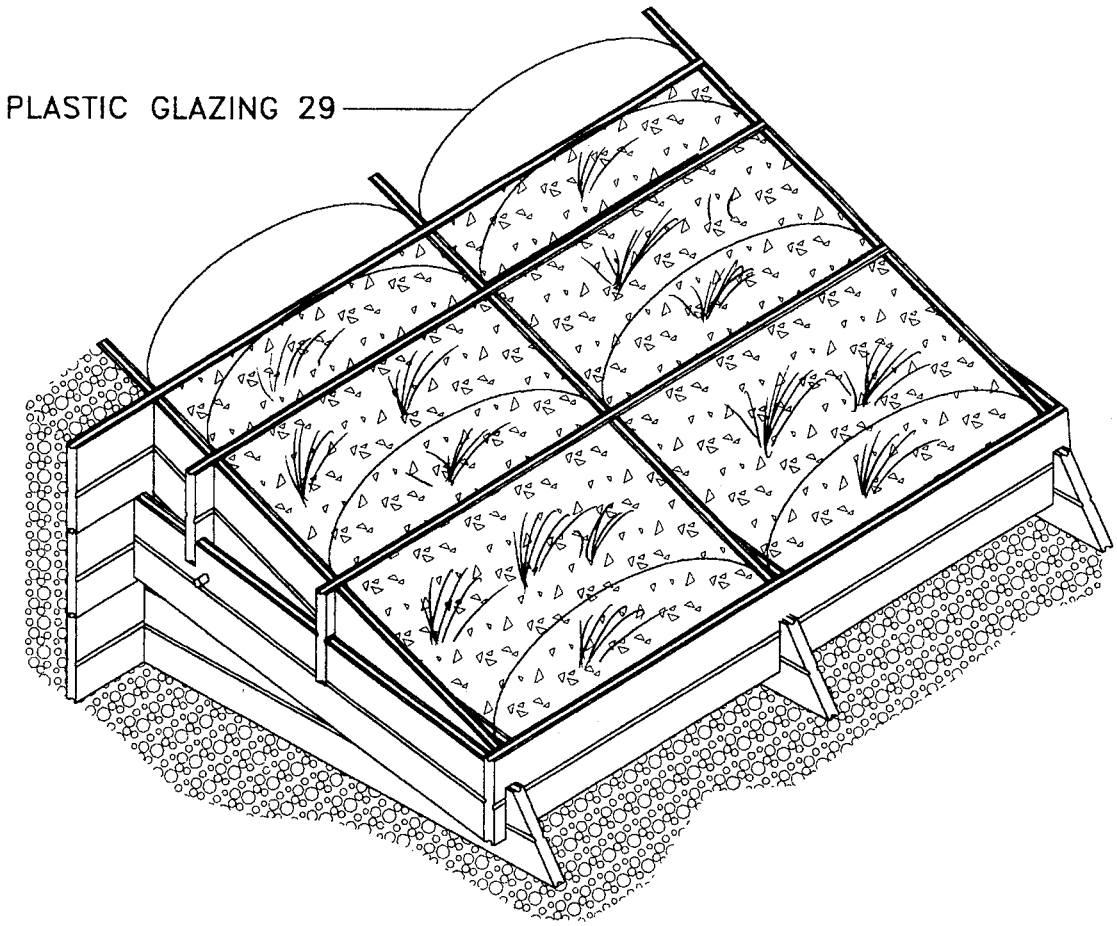
FIG. 25 glazed linear pod array.

FIG. 25 shows modules in a planter arrangement, with glazing 29.

I claim:

1. A topography structure system to provide means to stabilize earth contours and promote plantlife at the interface of water and landmass at slopes of zero degree to forty-five degrees from the horizontal, set upon earth at a predetermined location and grade, said system comprising:

A plurality preformed of planks, said planks being joined by interlocking notched means, each plank having at least one notch on one longitudinal upper or lower edge and arranged so as to receive the notch of an adjacent plank; said notches being at a predetermined angle so that the plank can be arranged to define three dimensional frames; forming contoured cell means;

Earth medium within said cell means being arranged at the necessary topographic angles, orientation and elevations to establish a predetermined linear biological benchmark required to provide the nourishment balance of solar insolation, water-cover, atmosphere and nutrient compulsory to sustain aquatic emergent vegetation and terrestrial vegetation and associated micro flora adjacent to and at the land and water interface.

2. The system of claim 1 wherein a hand gripping means is provided by continuous grooves in the side of said planks.

3. The system of claim 1 wherein a means for predetermined placement of said frames is provided by wells in the bottom planks fitted into prepositioned ground pin anchors.

4. The system of claim 1 wherein said planks are grooved for receiving compression fitting wedge splines to secure sheet fabric material thereto.

5. The system of claim 1 wherein a secure liner of sheet membrane is provided within the contoured cell means.

6. The system of claim 1 wherein the frames and membrane provide lined flow channel means within and across said system.

7. The system of claim 1 wherein said cells contain mesh plantlife retaining means to hold earth medium and aquatic emergent vegetation and terrestrial vegetation.

8. The system of claim 1 wherein a retention basin means is provided for environmental remediation vegetation.

9. The system of claim 1 wherein said cells provide a double bulkhead earth medium filled linear plank cavity wall means complete with spacer stakes plank holders, plank stiffeners and cap pins to from bulkheads and toes of earth medium.

10. The system of claim 1 wherein is provided the means to plant vegetation for stabilization against erosion.

11. The system of claim 1 wherein is provided the means to plant vegetation for remediation of toxic runoff and remediation of channeled fluids.

12. The system of claim 1 wherein the means to space plank at predetermined linear opening by inserting a double grooved block between the top groove and bottom groove of planks at intervals to allow for required drainage.

* * * * *